US005485639A

United States Patent [19]

Cavazos

[11] Patent Number: 5,485,639

[45] Date of Patent: Jan. 23, 1996

[54] MODULAR INNERSPRING AND BOX SPRING ASSEMBLIES

[76] Inventor: Frank G. Cavazos, 14040 Shoshoni Dr., Lockport, Ill. 60441

[21] Appl. No.: 254,735

[22] Filed: Jun. 6, 1994

Related U.S. Application Data

[63] Continuation-in-part of Ser. No. 203,100, Feb. 28, 1994.

[51] Int. Cl.[6] ..... A47C 23/04

[52] U.S. Cl. ..... 5/259.1; 5/260

[58] Field of Search ..... 5/259.1, 260, 258, 5/264, 270, 475, 477, 200.1, 201, 202, 240, 249, 251, 248, 252, 256, 285

[56] References Cited

U.S. PATENT DOCUMENTS

| | | | |
|---|---|---|---|
| 163,131 | 5/1875 | Alvord | 5/259.1 |
| 757,420 | 4/1904 | Smith | 5/259.1 |
| 871,244 | 11/1907 | Smith | 5/259.1 |
| 1,618,852 | 2/1927 | Tiffany | 5/260 |
| 1,746,942 | 2/1930 | Hise | 5/259.1 |
| 4,055,337 | 10/1977 | Laiche | 5/259.1 |

FOREIGN PATENT DOCUMENTS

| | | | |
|---|---|---|---|
| 609691 | 4/1925 | France | 5/260 |

*Primary Examiner*—Flemming Saether
*Attorney, Agent, or Firm*—Ernest Kettelson

[57] ABSTRACT

A mattress spring clip to secure the wire of a border wire assembly to coils of adjacent coil springs in an innerspring assembly for a mattress, wherein the clip comprises a unitary length of spring bias material, such as metal having a relatively broad width, and curved to form a pair of reverse loops, each having entrances which are narrower than their respective loop pockets whereby the entrances have to spread apart for the wire of a border wire assembly to pass into one of the loop pockets and for the coil of an adjacent coil spring to pass into the other loop pocket. The entrances then snap back to their original spring biased positions to hold the wire and coil in their respective pockets.

12 Claims, 25 Drawing Sheets

MODULAR INNERSPRING AND BOX SPRING ASSEMBLIES

PRIOR APPLICATIONS

This application is a continuation-in-part of co-pending application Ser. No. 08/203,100 filed Feb. 28, 1994.

BACKGROUND OF THE INVENTION

This invention relates to the field of spring assemblies for mattresses which can be assembled by an end use purchaser from component parts.

Prior art spring assemblies for mattresses which are closest to the present invention of which the inventor has knowledge include those described in the following United States patents.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,459,540 discloses a sectional mattress comprising three separate sections that are laid end to end to make up a complete mattress and can be interchanged in their relationship to each other. The innersprings within each section are encased in bags.

OBJECT OF THE INVENTION

The modular innerspring and box spring assemblies in accordance with the present invention provide an improvement over the prior art in that end use customers can buy the component parts and assemble their own completed modular innerspring assemblies and box spring assemblies. The modular innerspring assemblies can then be used by the end use customer to put together his own innerspring mattress from component parts in accordance with a separate invention for which a separate patent application is being filed concurrently.

The modular innerspring assembly is made from innerspring modules in different sizes to make twin, twin extra long, full, full extra long, queen and king size innerspring assemblies. The coils in each module are held together by helical wire fasteners comprising an elongated wire wound in a helix whereby the wire forms a helical cylindrical wall surrounding a cylindrical bore in which the coils of adjacent coil springs are received to hold them together.

When the innerspring modules are placed next to each other at their adjacent sides and ends to make up a completed innerspring assembly of the desired size, a border wire assembly is then secured around the top and bottom peripheral edges of such completed assembly by double hook clip members, one hook end receiving a portion of the border wire and the other hook end receiving the facing portion the top coil of an adjacent spring in the case of the top border wire assembly and of the bottom coil of the adjacent spring in the case of the bottom border wire assembly.

Each border wire assembly comprises L-shaped wire members for each corner, and straight wire members where needed to connect the L-shaped wire members at each corner. Elongated sleeve members are provided to receive the adjacent ends of the wire members, which together with the double hook clips hold the border wire assemblies to the periphery of the completed modular innerspring assemblies to thereby hold the modules of the completed assemblies in place as a completed unit.

The modular box spring assembly in accordance with this invention is made from box spring modules in different sizes to also make twin, twin extra long, full, full extra long, queen and king size box spring assemblies. The king size assemblies may be two separate twin size extra long modular box spring assemblies placed side by side.

The box spring modules comprise a wood frame made up of end strips and side strips with intermediate slots therebetween to which upwardly extending coil springs or Z-shaped springs are secured. Four box spring modules are laid side by side and end to end to make up a completed modular box spring assembly and connected together by elongated L-shaped angle irons whose horizontal legs are bolted to the frame and whose vertical legs extend upwardly above the level of the frame having apertures to receive bolts that secure facing vertical legs of the angle irons of adjacent box spring modules together.

Other advantages and features of the modular innerspring and box spring assemblies in accordance with this invention will become apparent from the detailed description which follows and from the accompanying drawings.

DESCRIPTION OF PREFERRED EMBODIMENT

Figure 1:
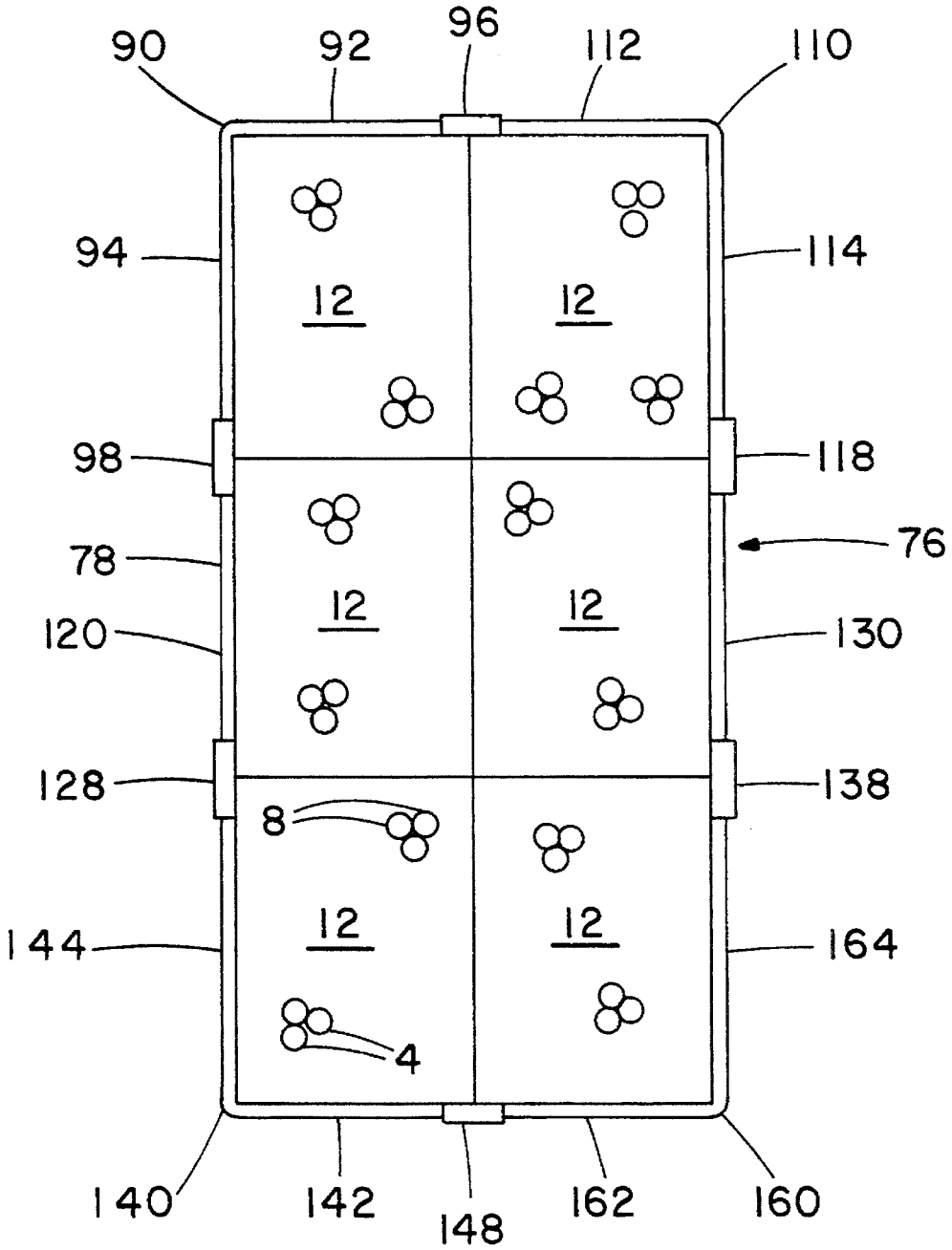
FIG. 1 is a top plan view of an assembled twin size modular innerspring assembly in accordance with this invention.
Figure 2:
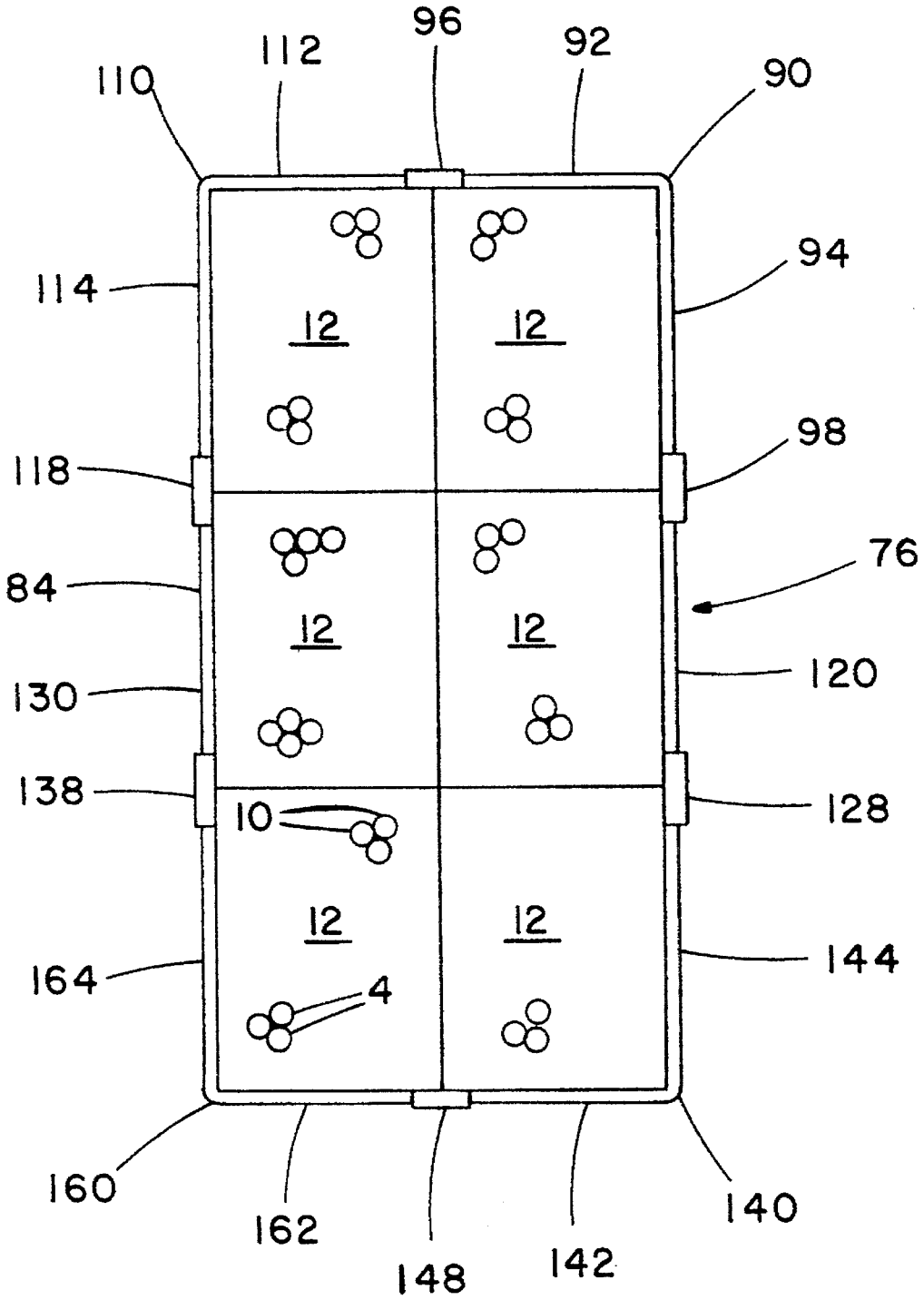
FIG. 2 is a bottom plan view of the modular innerspring assembly of FIG. 1.
Figure 3:
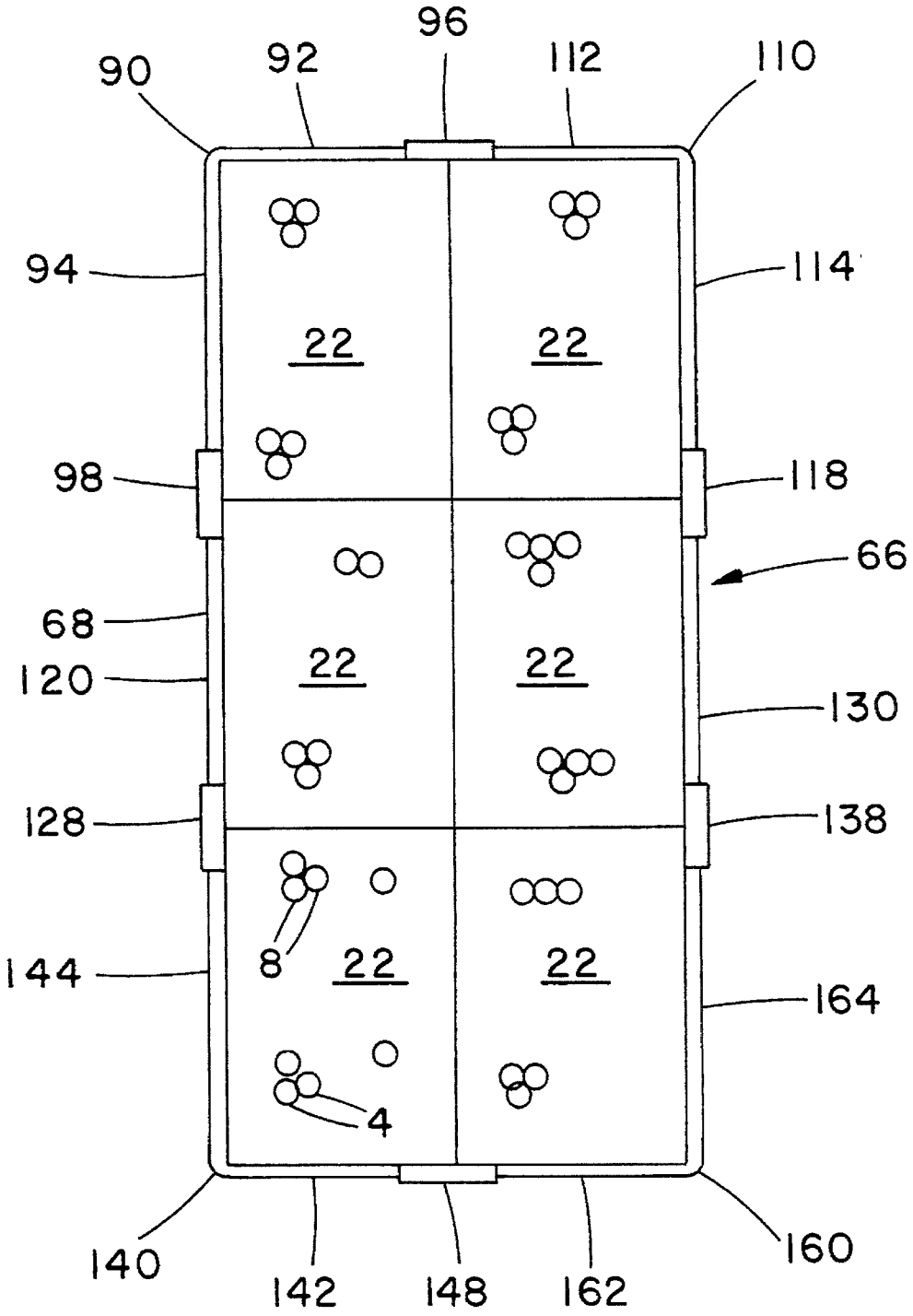
FIG. 3 is a top plan view of an assembled twin size extra long modular innerspring assembly in accordance with this invention.
Figure 4:
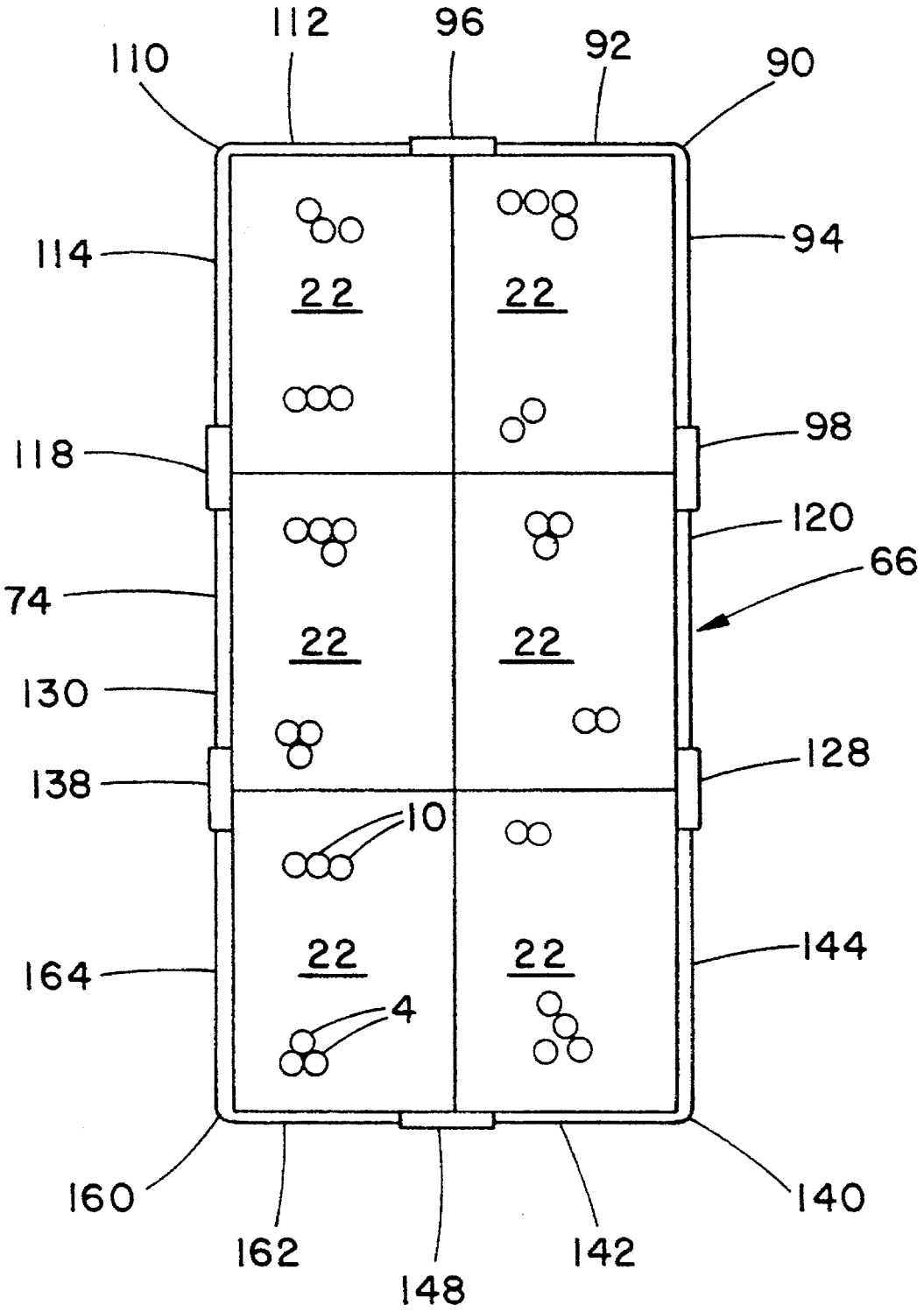
FIG. 4 is a bottom plan view of the modular innerspring assembly of FIG. 3.
Figure 5:
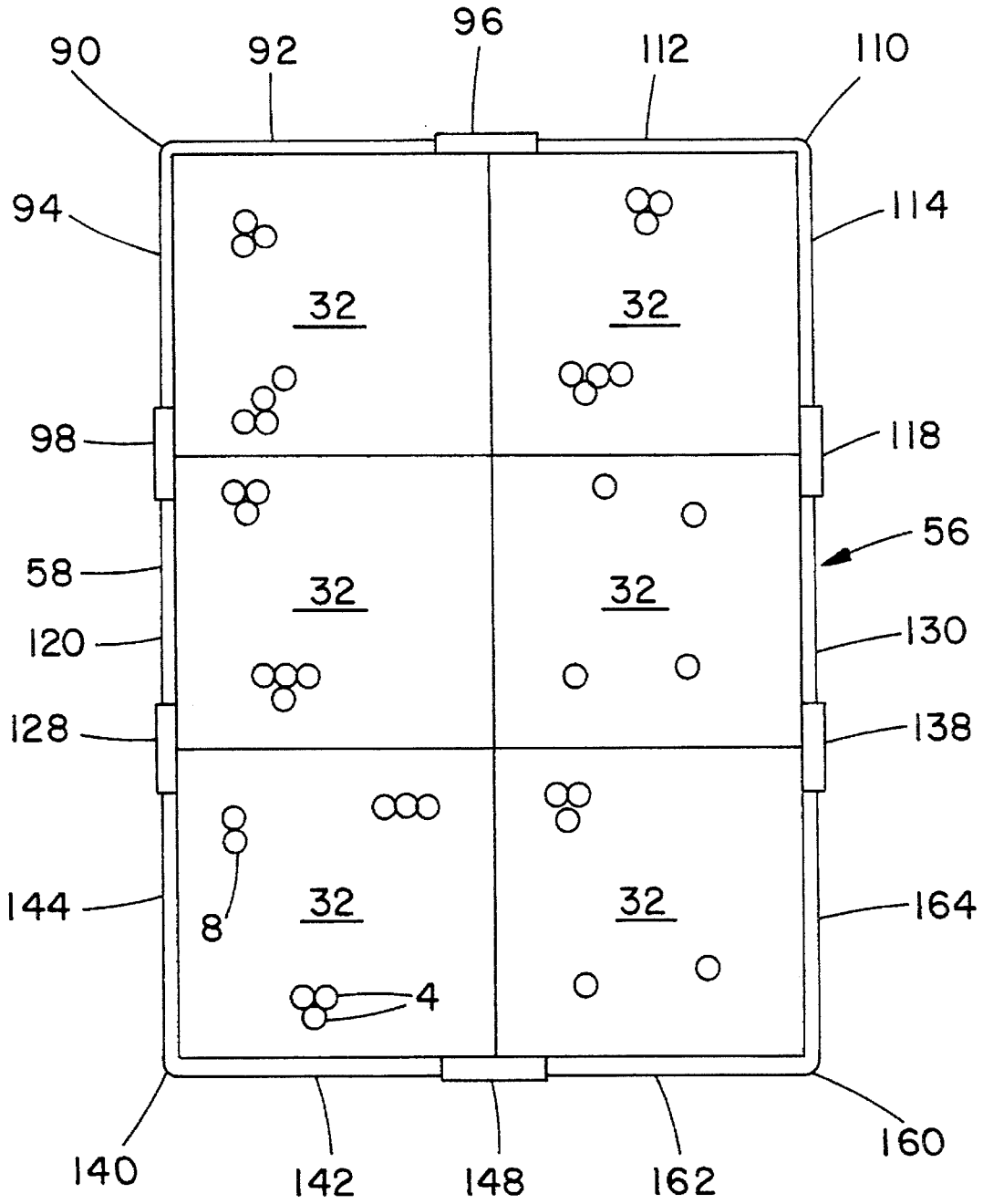
FIG. 5 is a top plan view of an assembled full size modular innerspring assembly in accordance with this invention.
Figure 6:
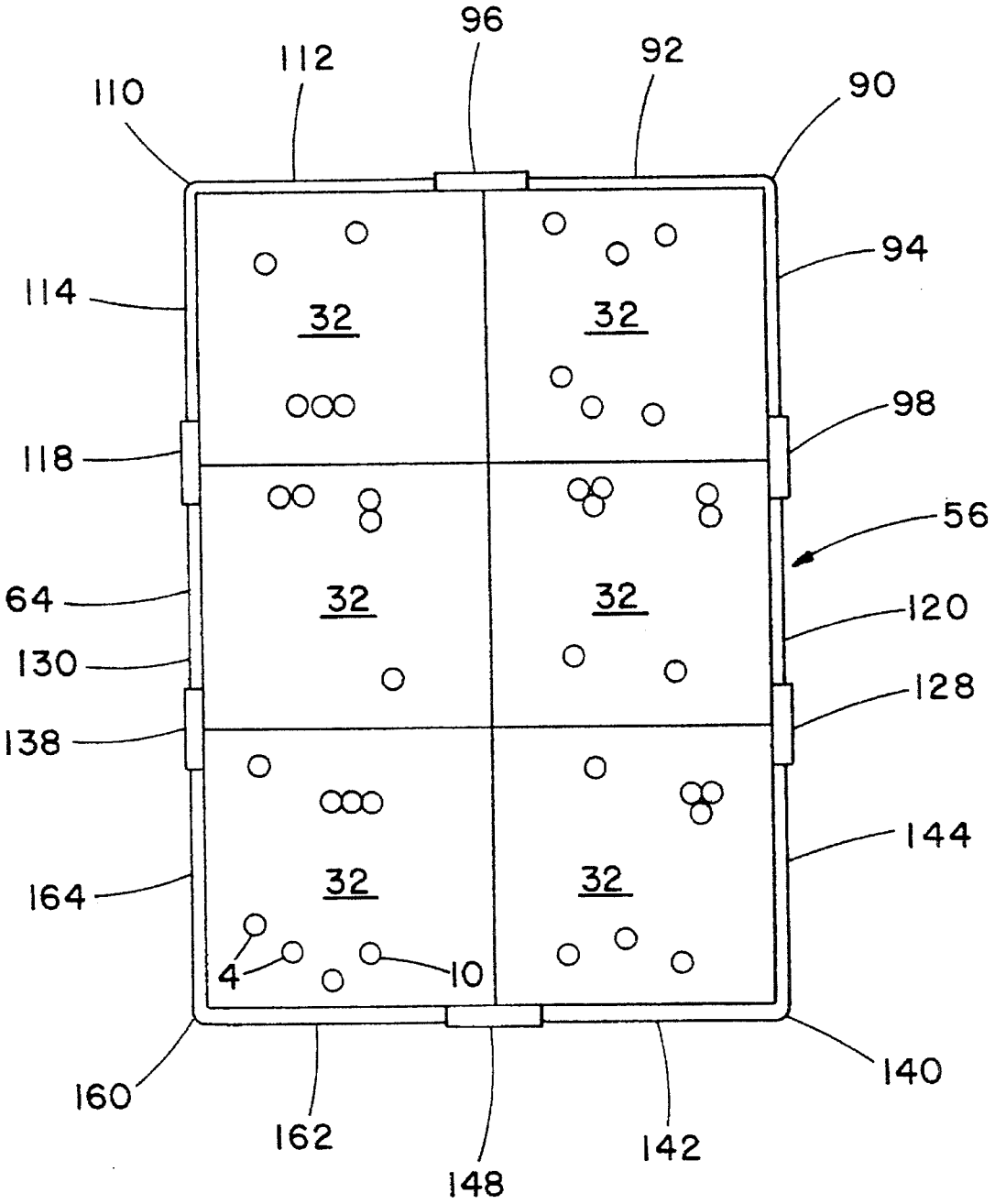
FIG. 6 is a bottom plan view of the modular innerspring assembly of FIG. 5.
Figure 7:
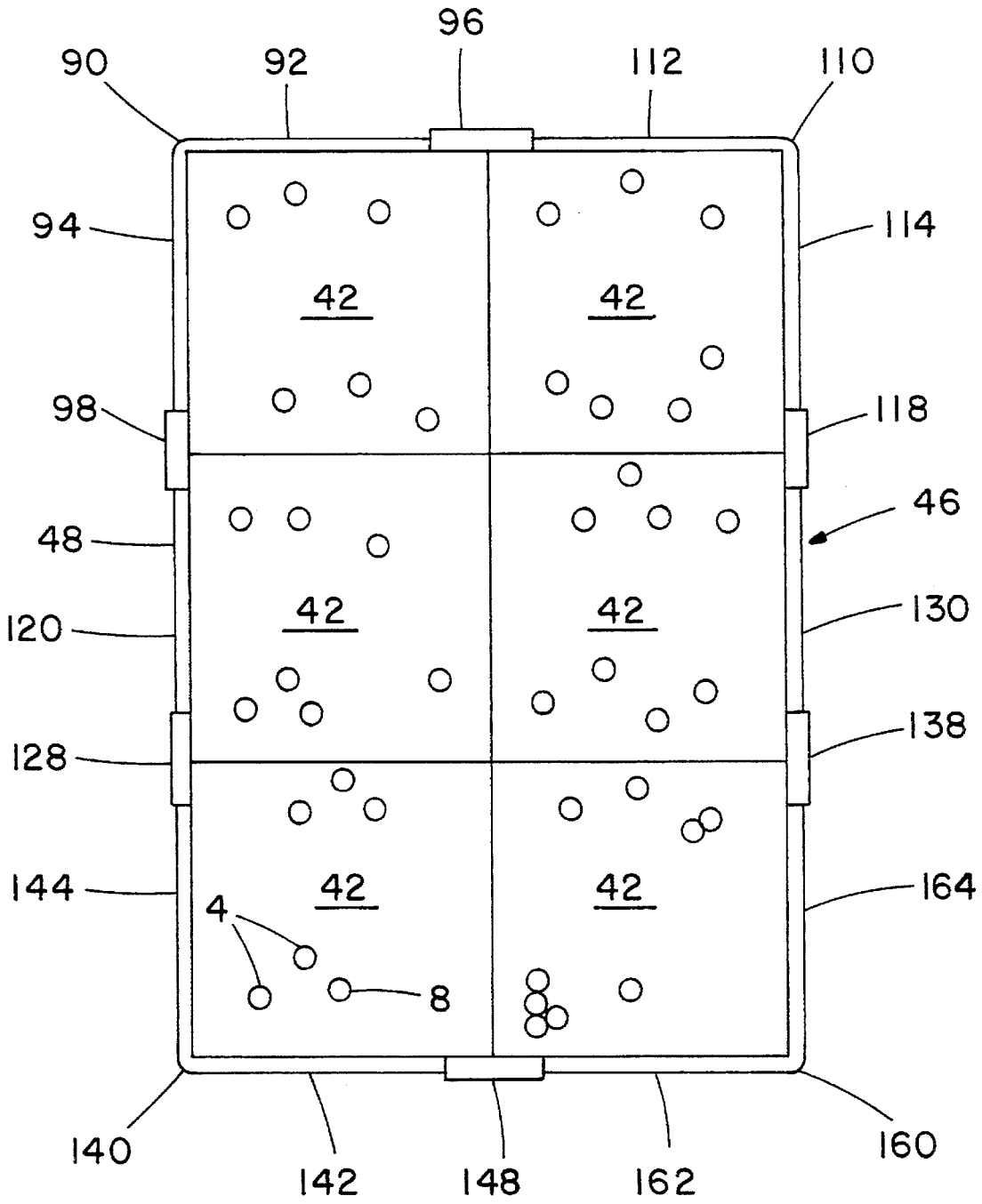
FIG. 7 is a top plan view of an assembled full size extra long modular innerspring assembly in accordance with this invention.
Figure 8:
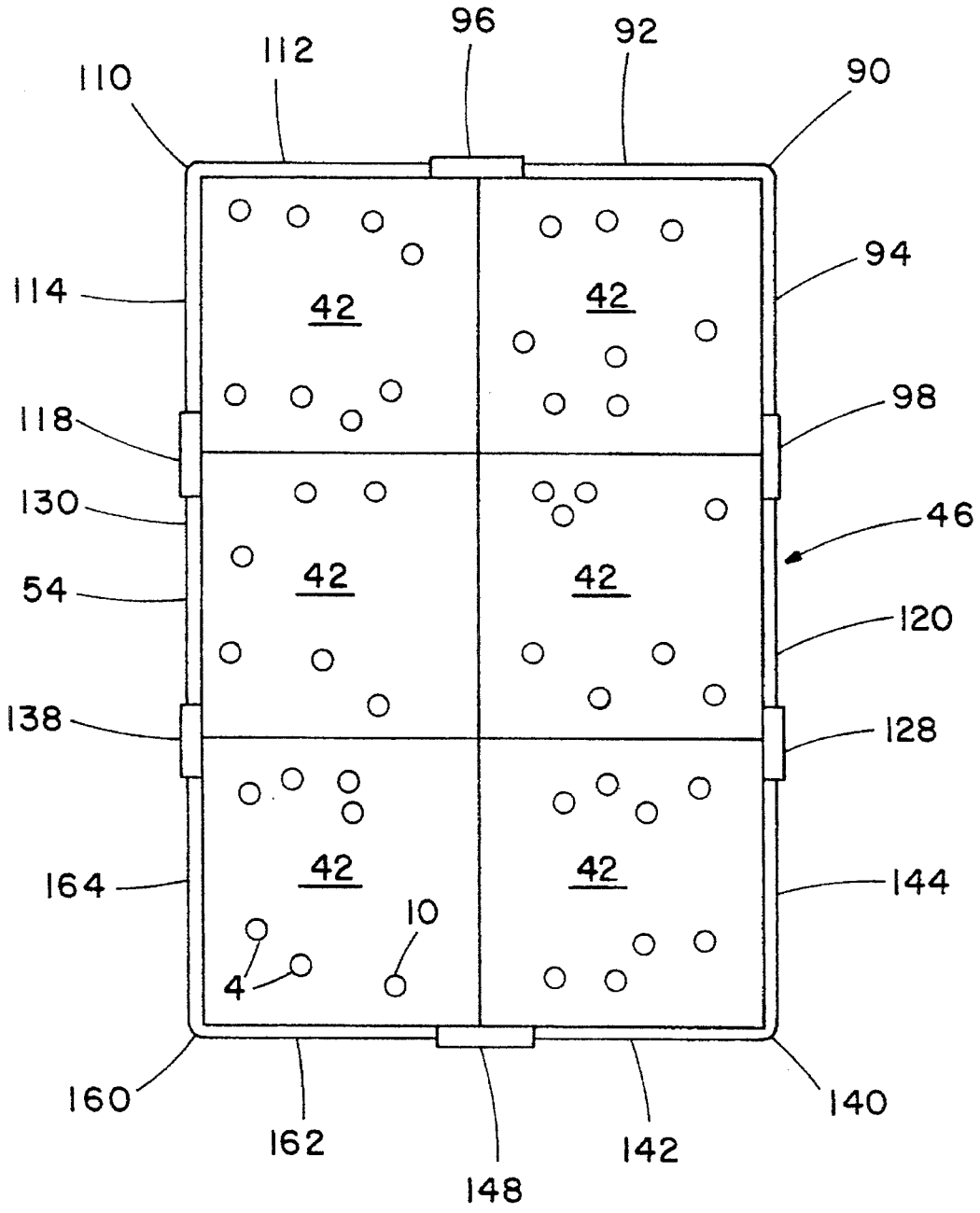
FIG. 8 is a bottom plan view of the modular innerspring assembly of FIG. 7.
Figure 9:
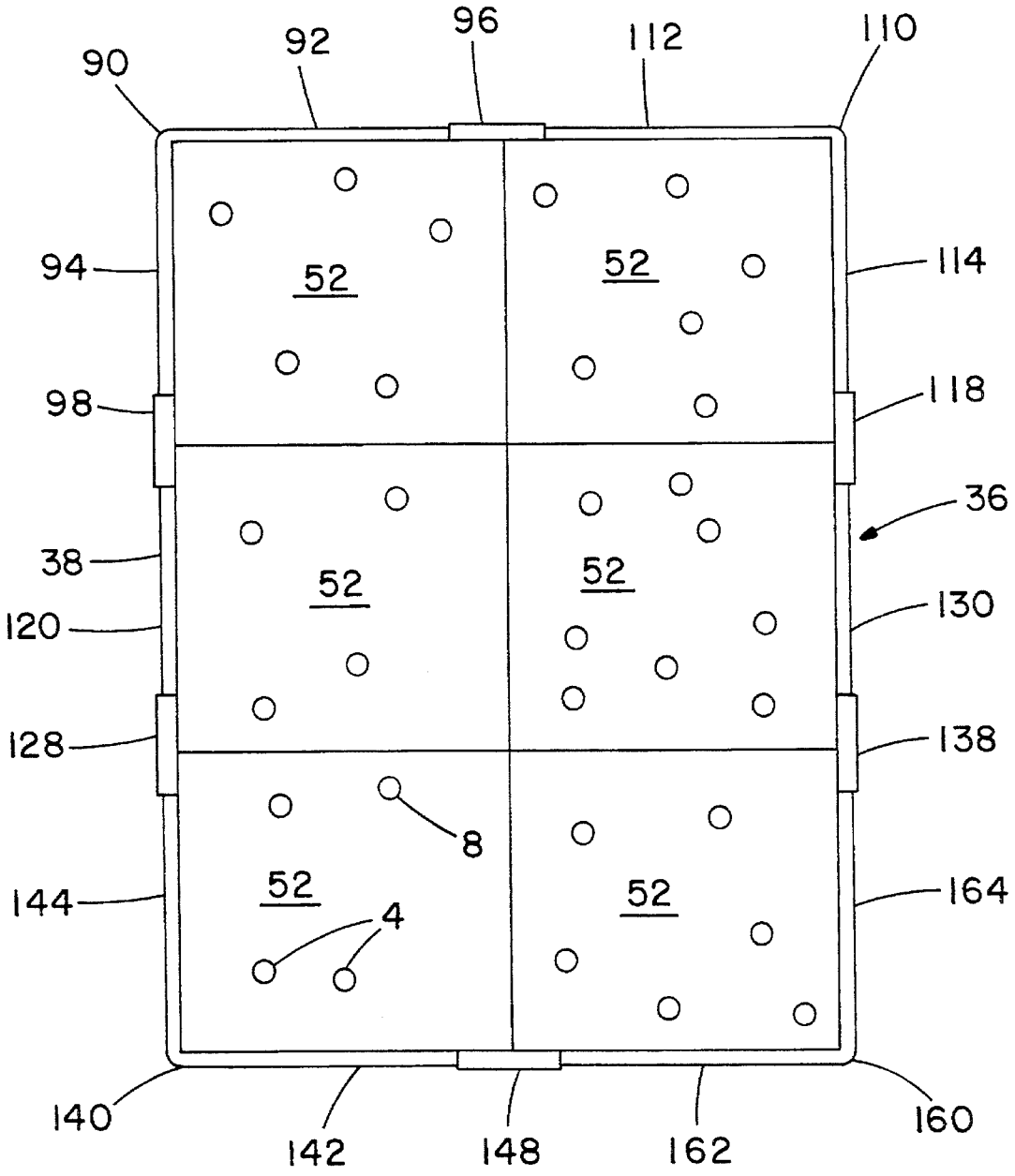
FIG. 9 is a top plan view of an assembled queen size modular innerspring assembly in accordance with this invention.
Figure 10:
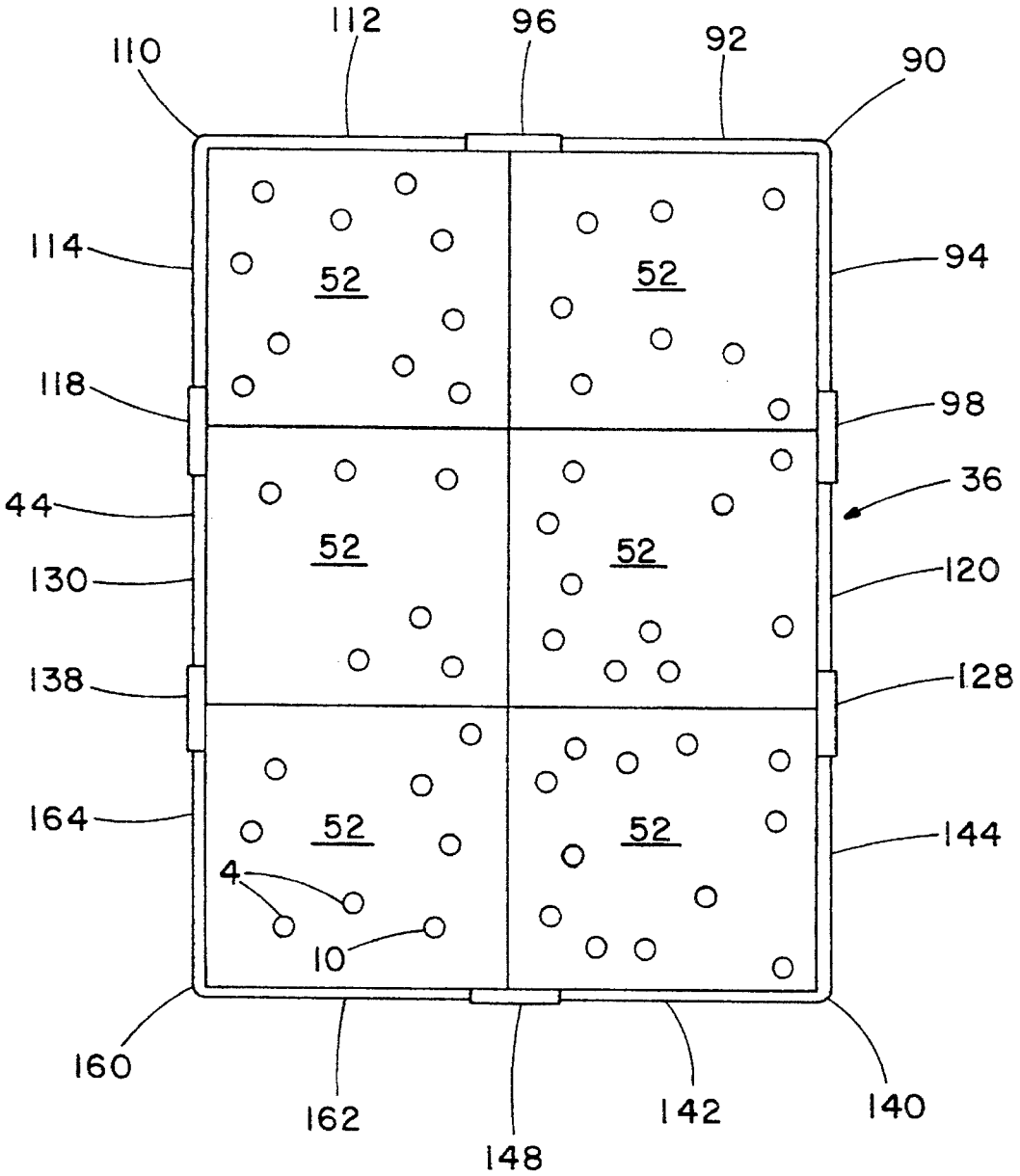
FIG. 10 is a bottom plan view of the modular innerspring assembly of FIG. 9.
Figure 11:
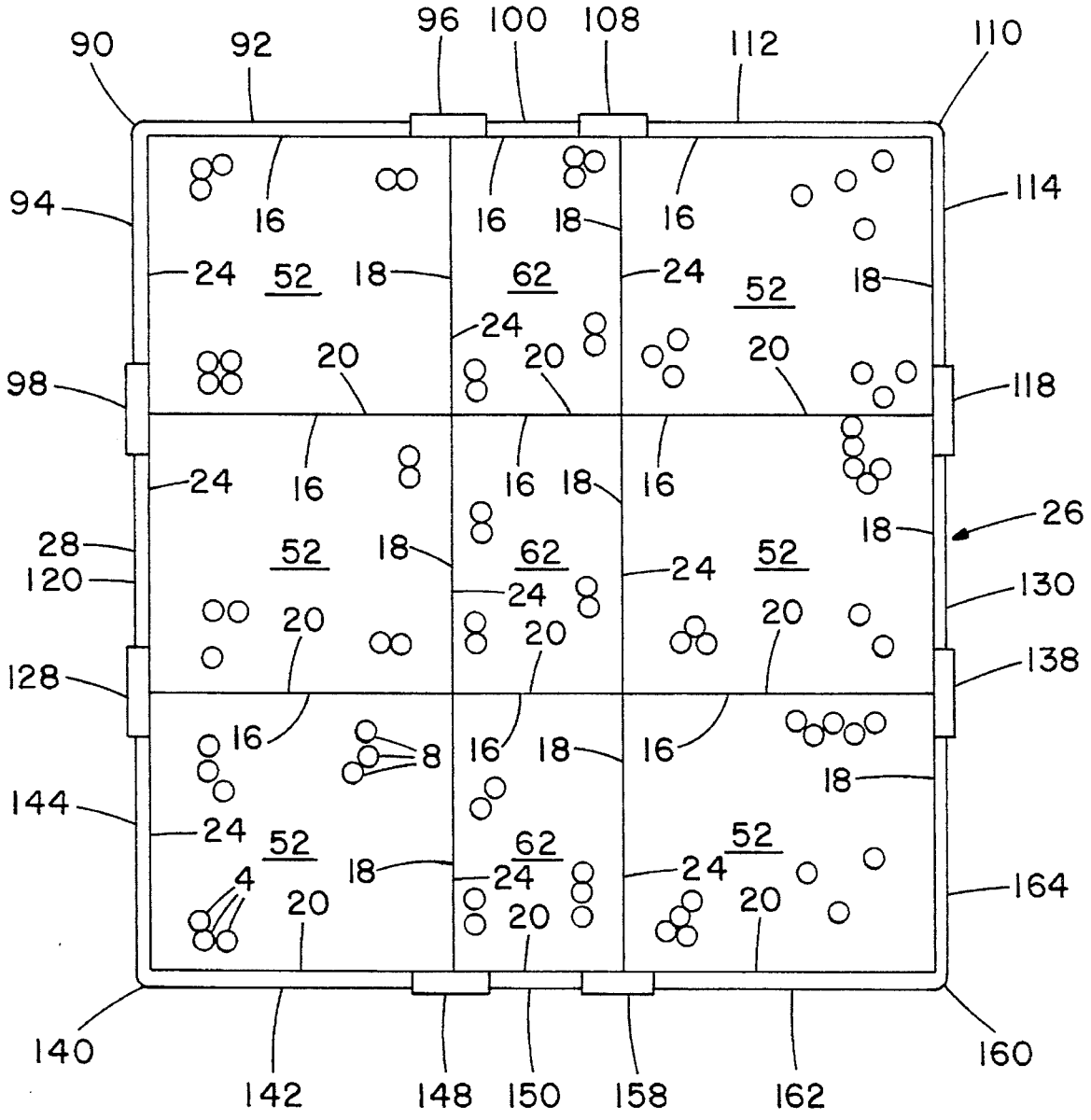
FIG. 11 is a top plan view of an assembled king size modular innerspring assembly in accordance with this invention.
Figure 12:
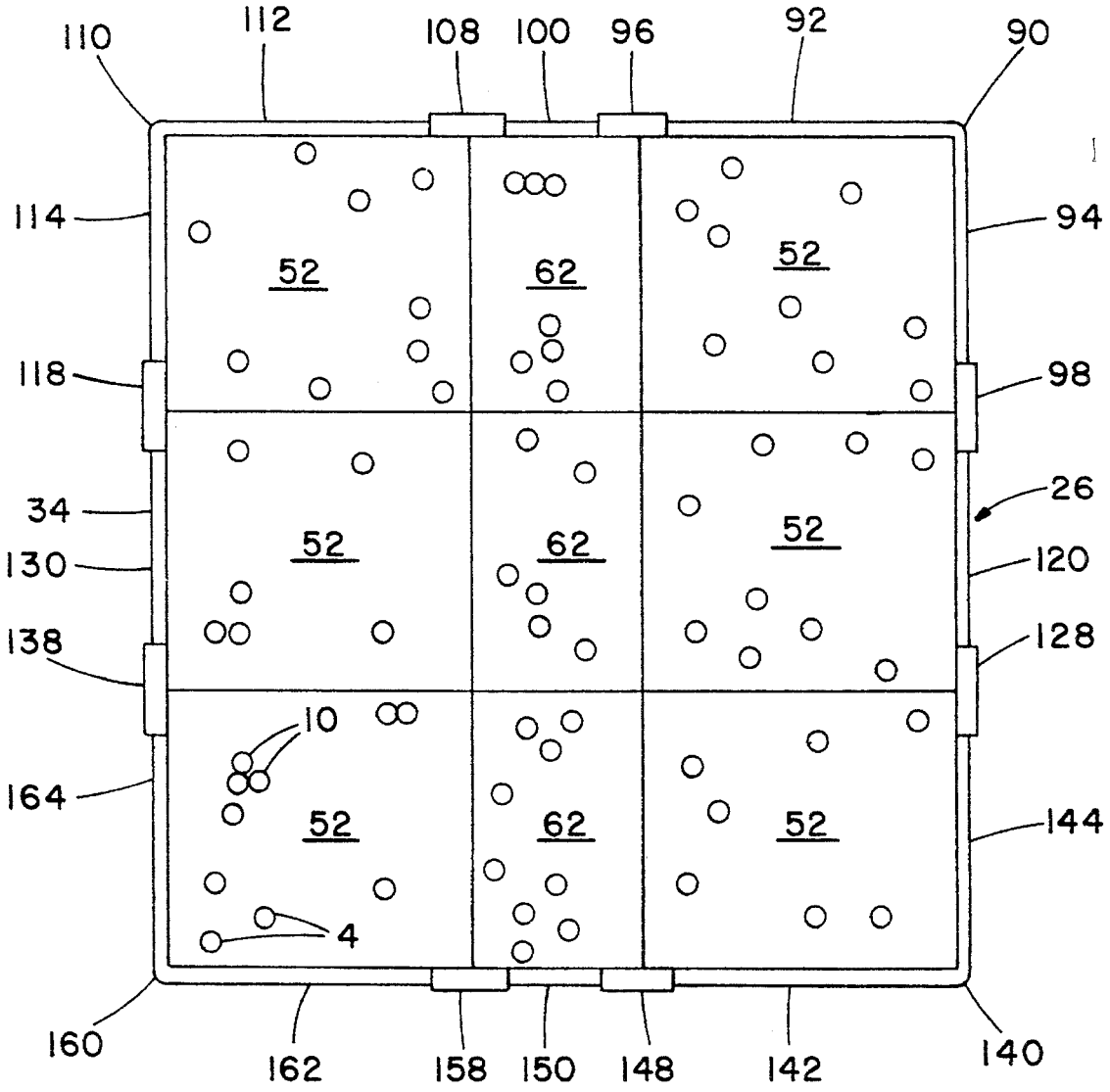
FIG. 12 is a bottom plan view of the modular innerspring assembly of FIG. 11.
Figure 13:
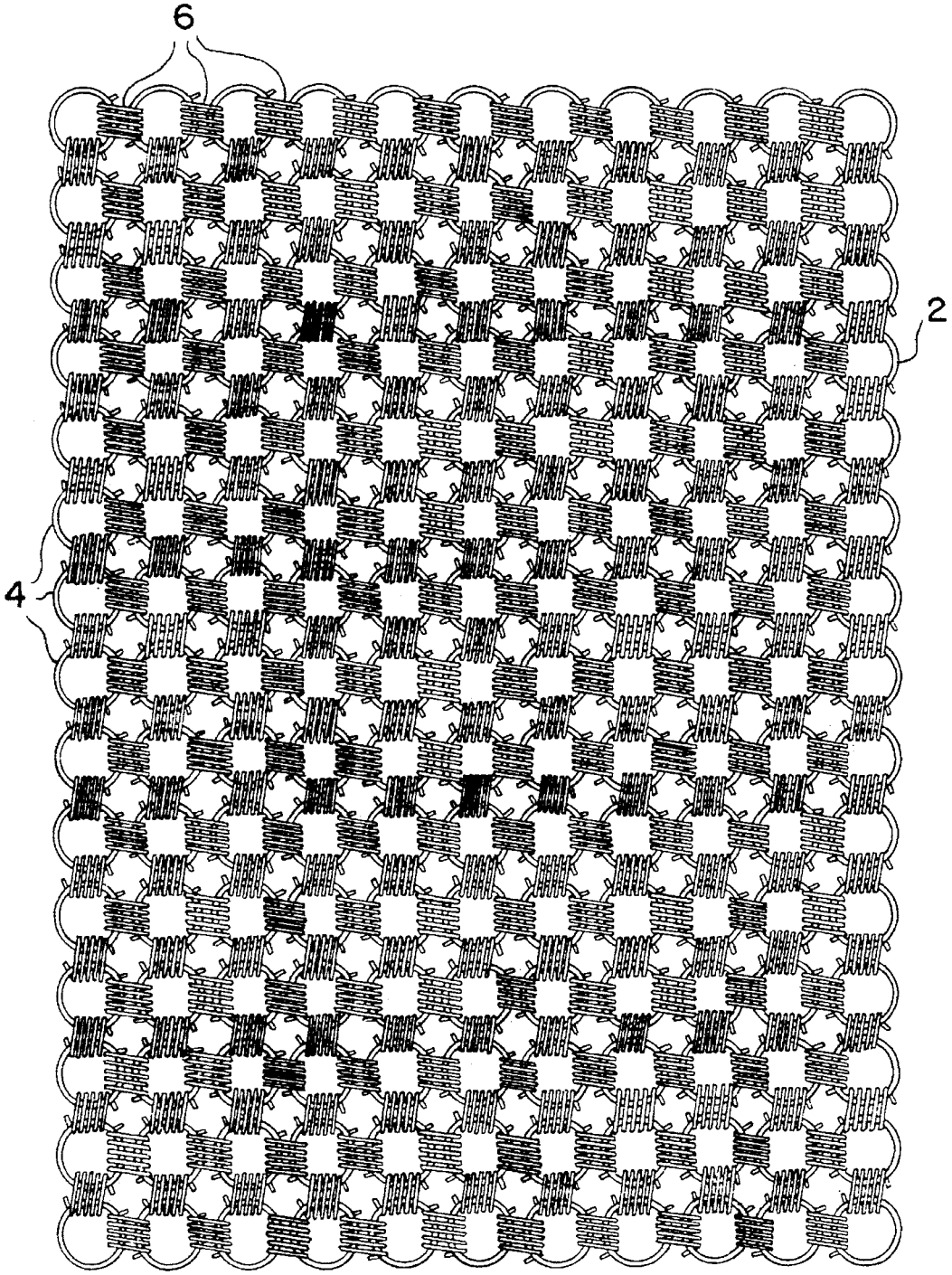
FIG. 13 is a top plan view of a single innerspring module in accordance with this invention shown before it has been connected to another module.
Figure 14:
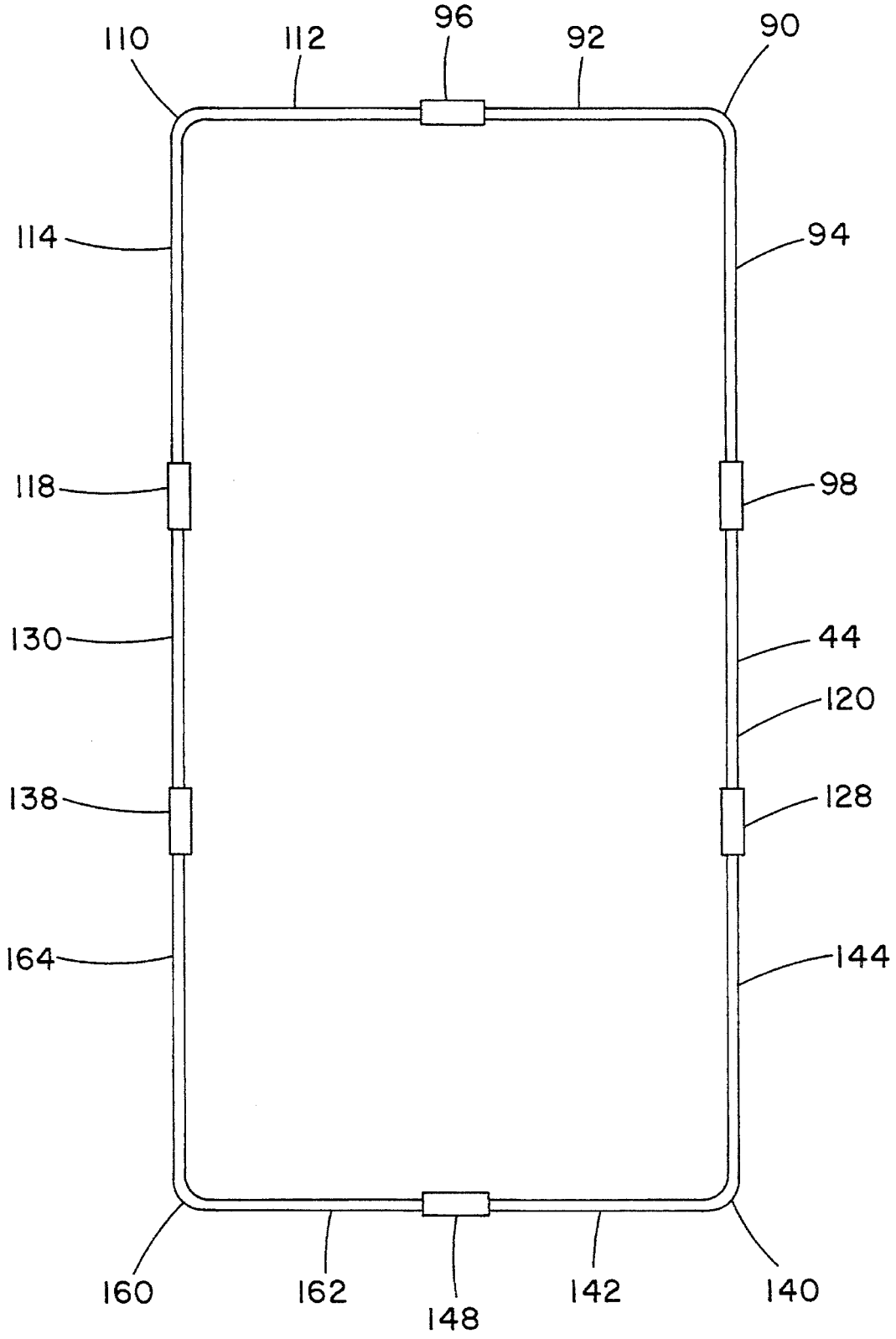
FIG. 14 is a plan view of the top peripheral border wire assembly for connection to the top coils of adjacent coil springs of assembled modules held in place within the boundary of the peripheral border wire assemblies.
Figure 15:
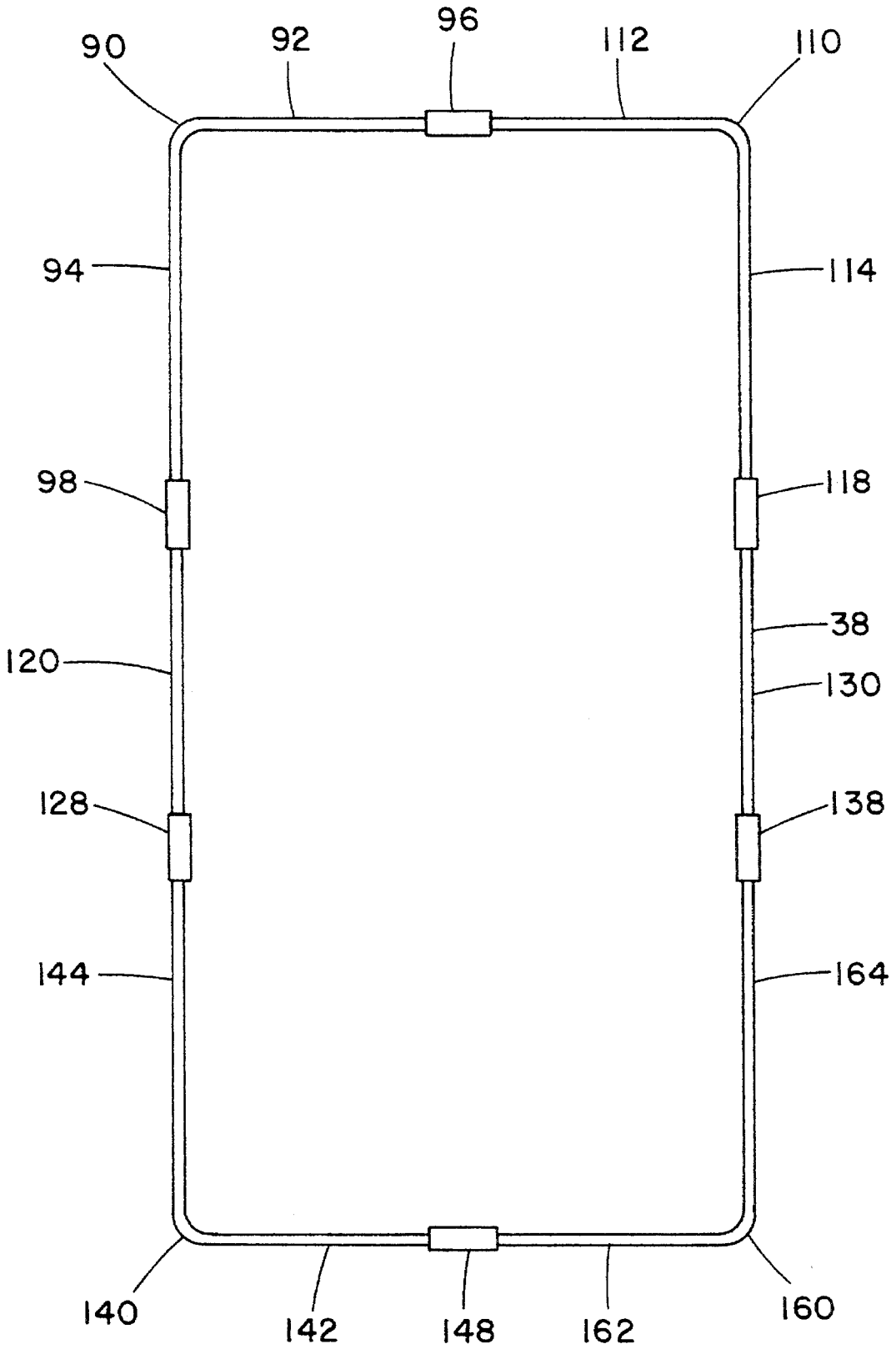
FIG. 15 is a plan view of the bottom peripheral border wire assembly for connection to the bottom coils of adjacent coil springs of the assembled modules.
Figure 16:
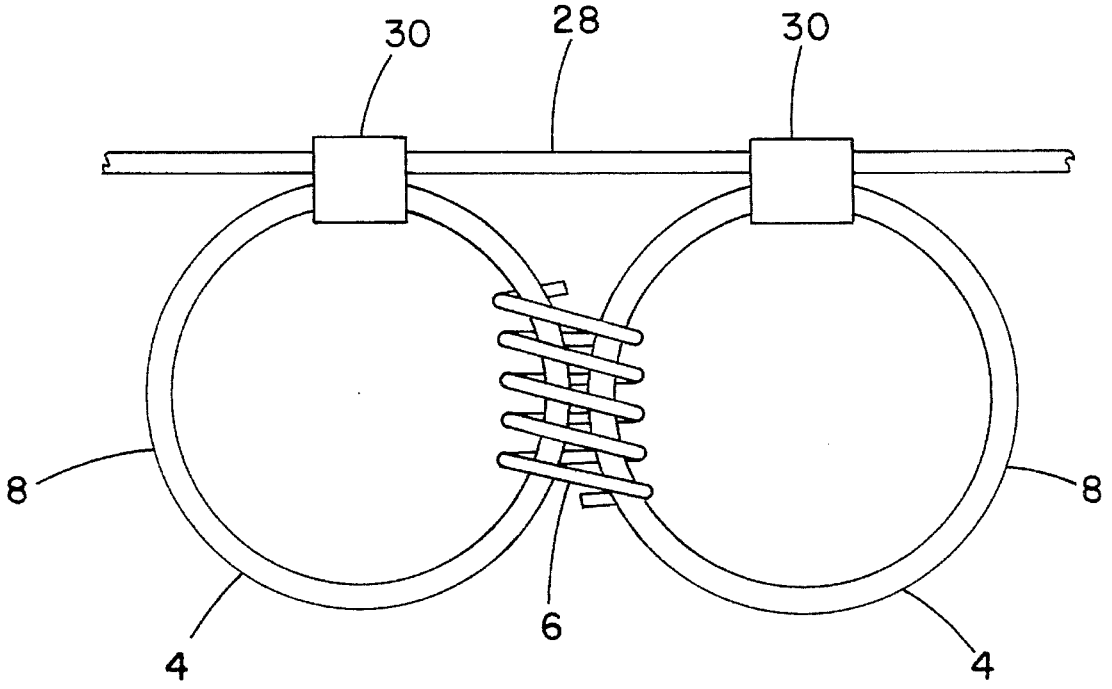
FIG. 16 is a top plan view of a segment of an innerspring module and of the top peripheral border wire assembly, enlarged to more clearly show the connection of the top coil of two coil springs to the top peripheral border wire assembly and to also show the connection of the coils to each other.
Figure 17:
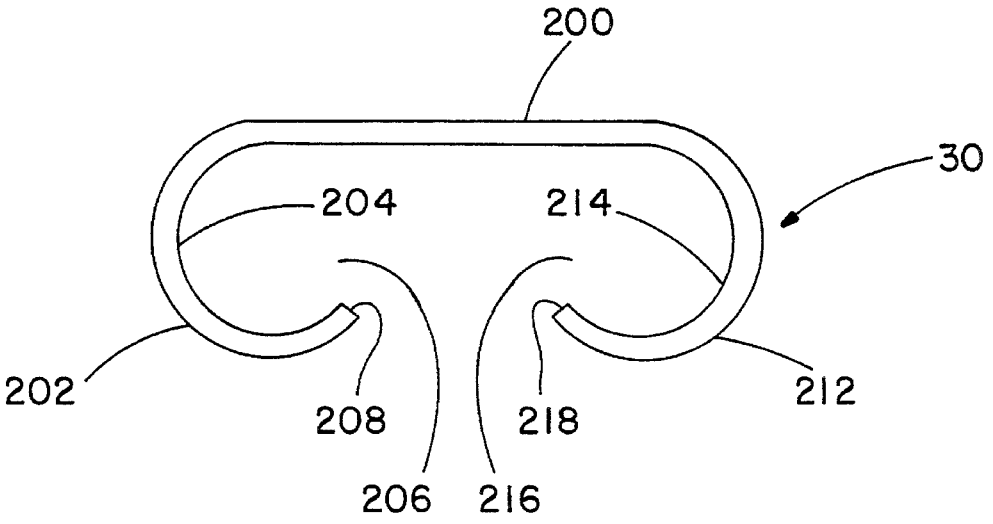
FIG. 17 is an elevation view, enlarged to more clearly show the construction of the connecting clips which secure the peripheral border wire assemblies to the coils of adjacent coil springs.
Figure 18:
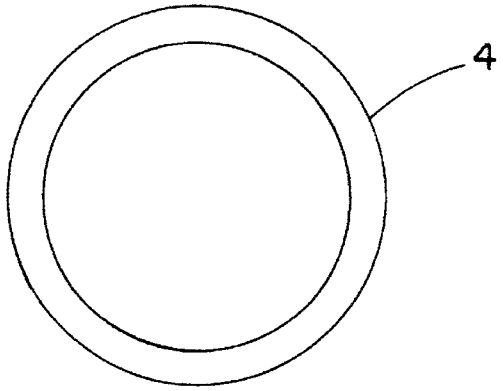
FIG. 18 is a top plan view of one of the coil springs of a modular innerspring module in accordance with this invention.
Figure 19:
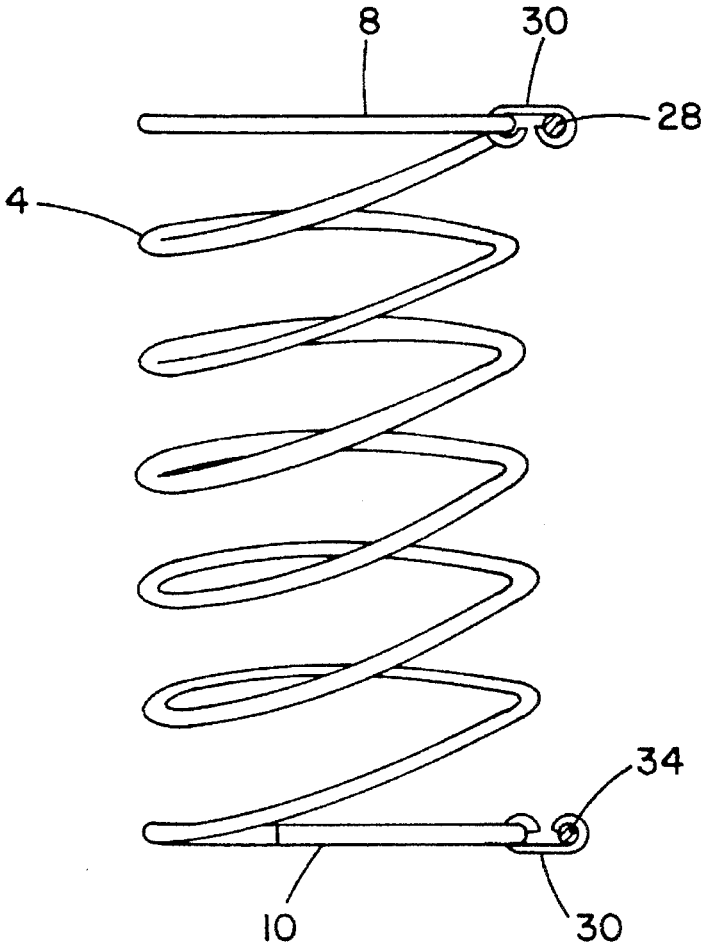
FIG. 19 is an elevation view of a coil spring as shown in FIG. 18, also showing its top and bottom coils connected to respective top and bottom peripheral border wire assemblies which are shown in section.
Figure 20:
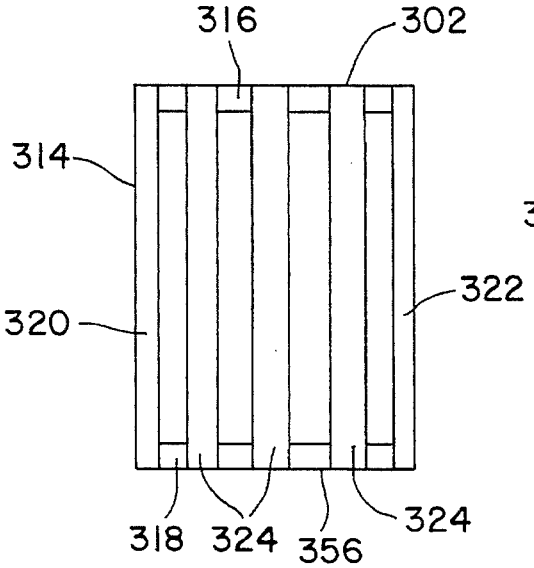
FIG. 20 is a bottom plan view of a box spring module needed to assemble a queen size modular box spring in accordance with this invention.
Figure 21:
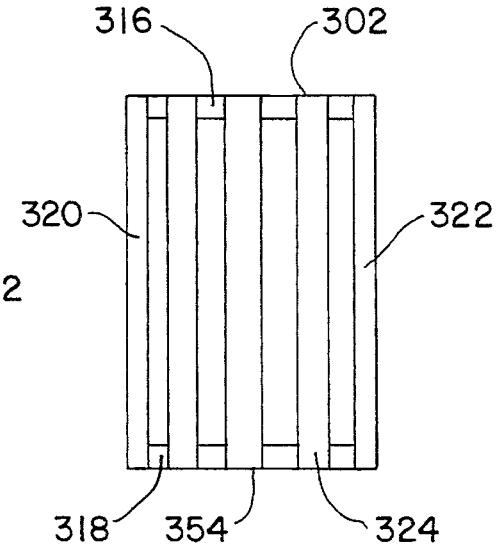
FIG. 21 is a bottom plan view of a box spring module needed to assemble a full size extra long modular box spring in accordance with this invention.
Figure 22:
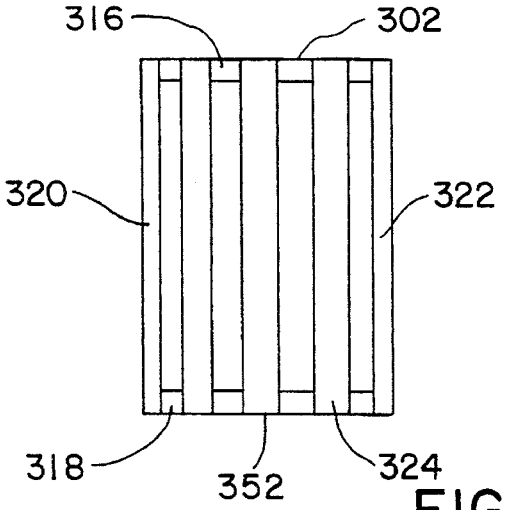
FIG. 22 is a bottom plan view of box spring module needed to assemble a full size modular box spring in accordance with this invention.
Figure 23:
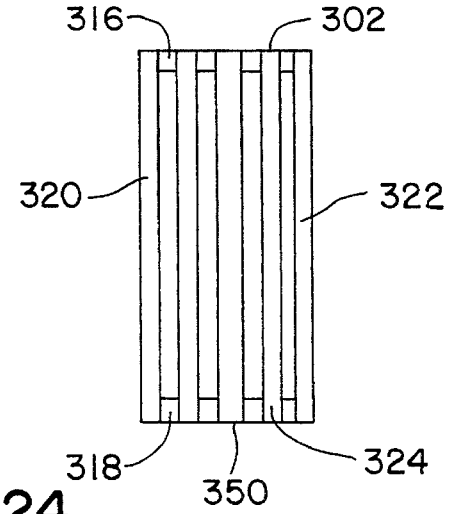
FIG. 23 is a bottom plan view of a box spring modular needed to assemble a twin size extra long modular box spring in accordance with this invention.
Figure 24:
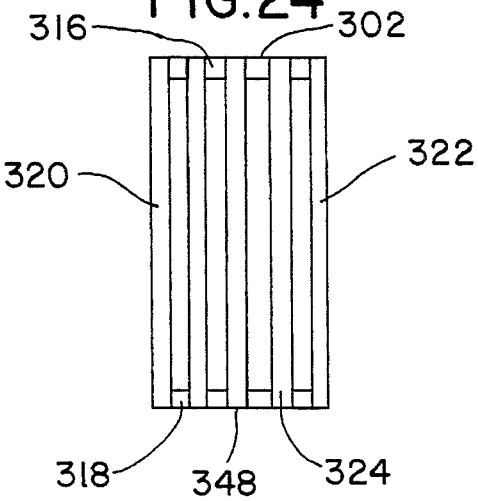
FIG. 24 is a bottom plan view of a box spring module needed to assemble a twin size modular box spring in accordance with this invention.
Figure 25:
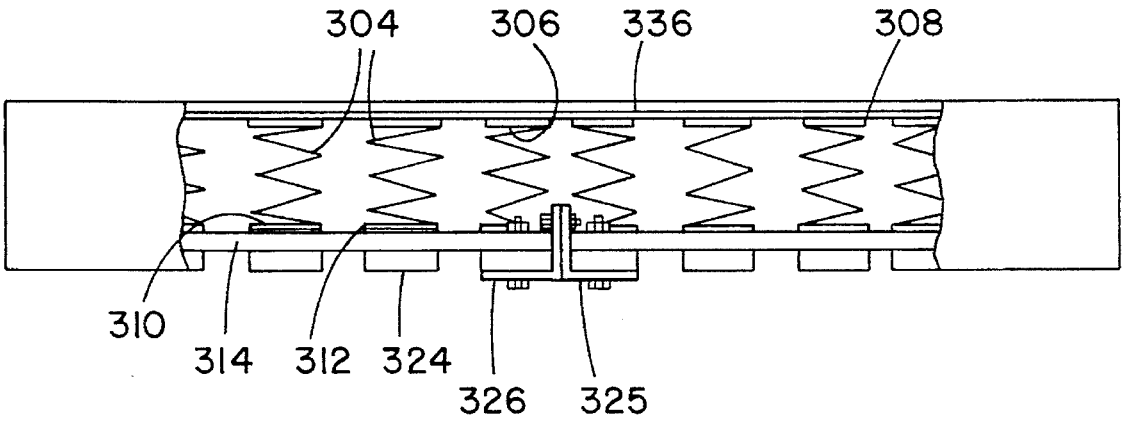
FIG. 25 is an end elevation view of an assembled modular box spring in accordance with this invention with a portion of the side wall covering broken away to illustrate the connection of two modules in side by side relationship.
Figure 26:
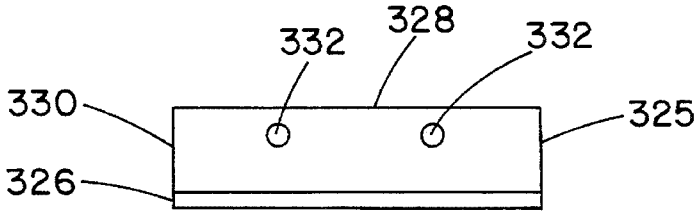
FIG. 26 is an elevation view from the front of an angle iron connecting member used to connect box spring modules together.
Figure 27:
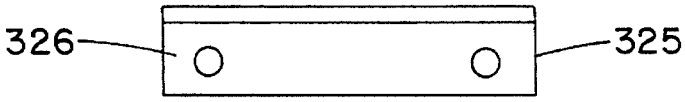
FIG. 27 is a plan view of the angle iron connecting member of FIG. 26.
Figure 28:
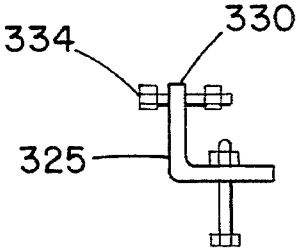
FIG. 28 is an end elevation view of the angle iron connecting members of 26.
Figure 29:
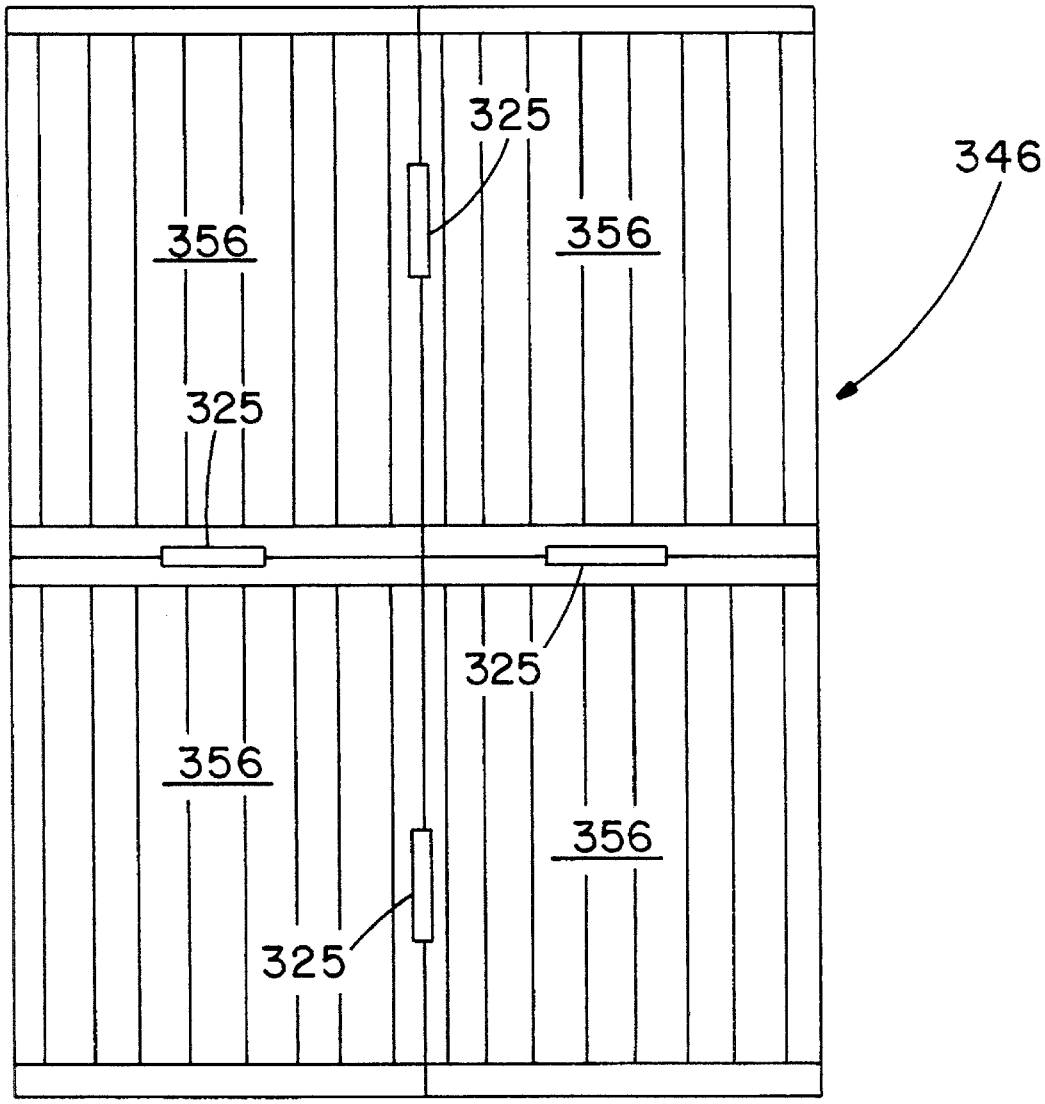
FIG. 29 is a plan view of an assembled queen size modular box spring in which the spring members and covering are removed to show the connection of the frame of each adjacent module.
Figure 30:
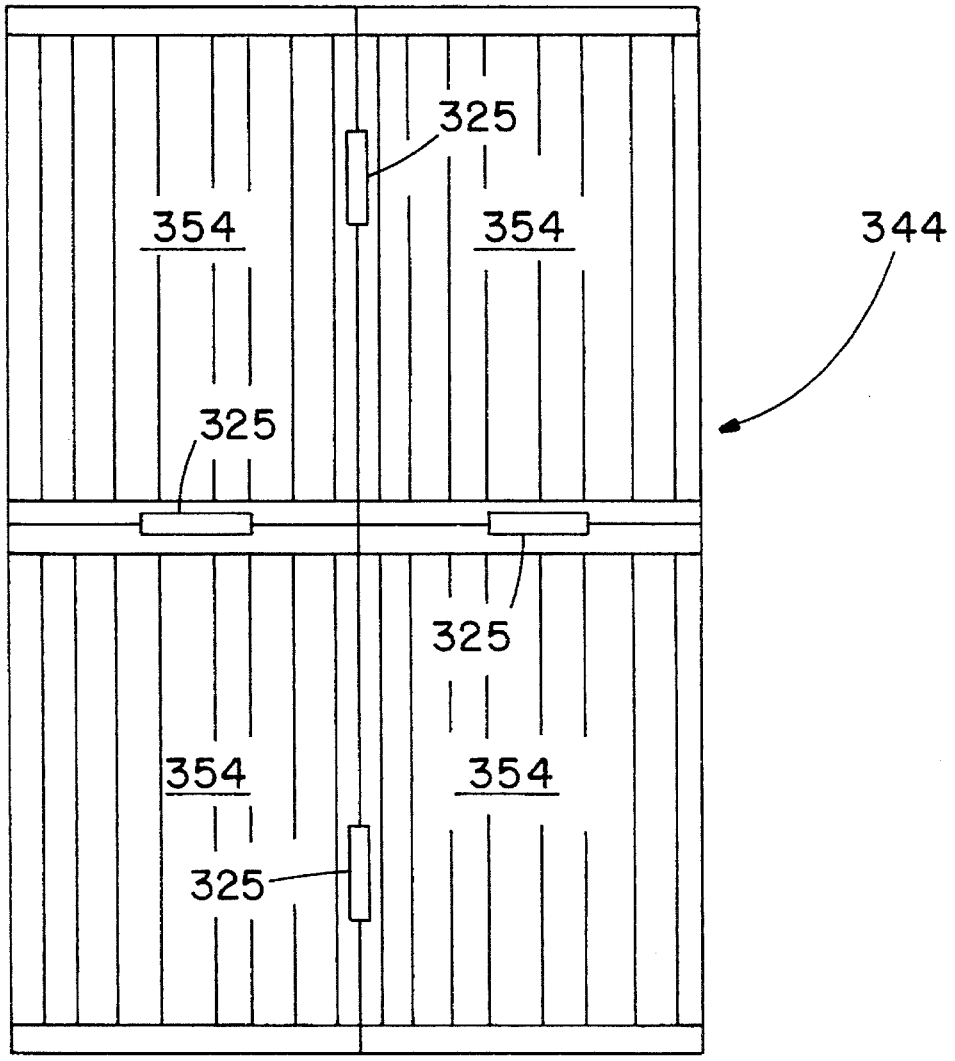
FIG. 30 is a plan view of an assembled full size extra long modular box spring in which the spring members and covering are removed to show the connection of the frames of each adjacent module.
Figure 31:
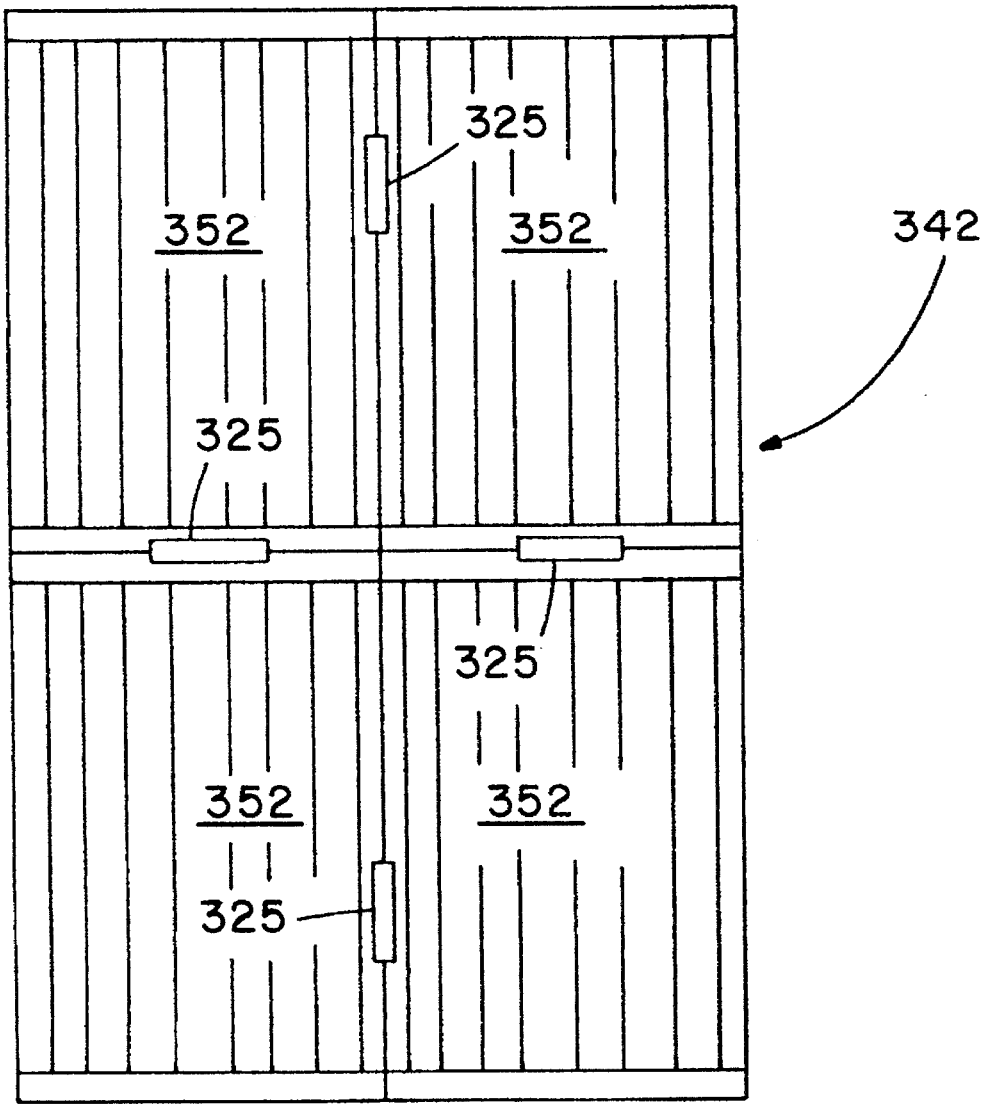
FIG. 31 is a plan view of an assembled full size modular box spring which the spring members and covering are removed to show the connection of the frames of each adjacent module.
Figure 32:
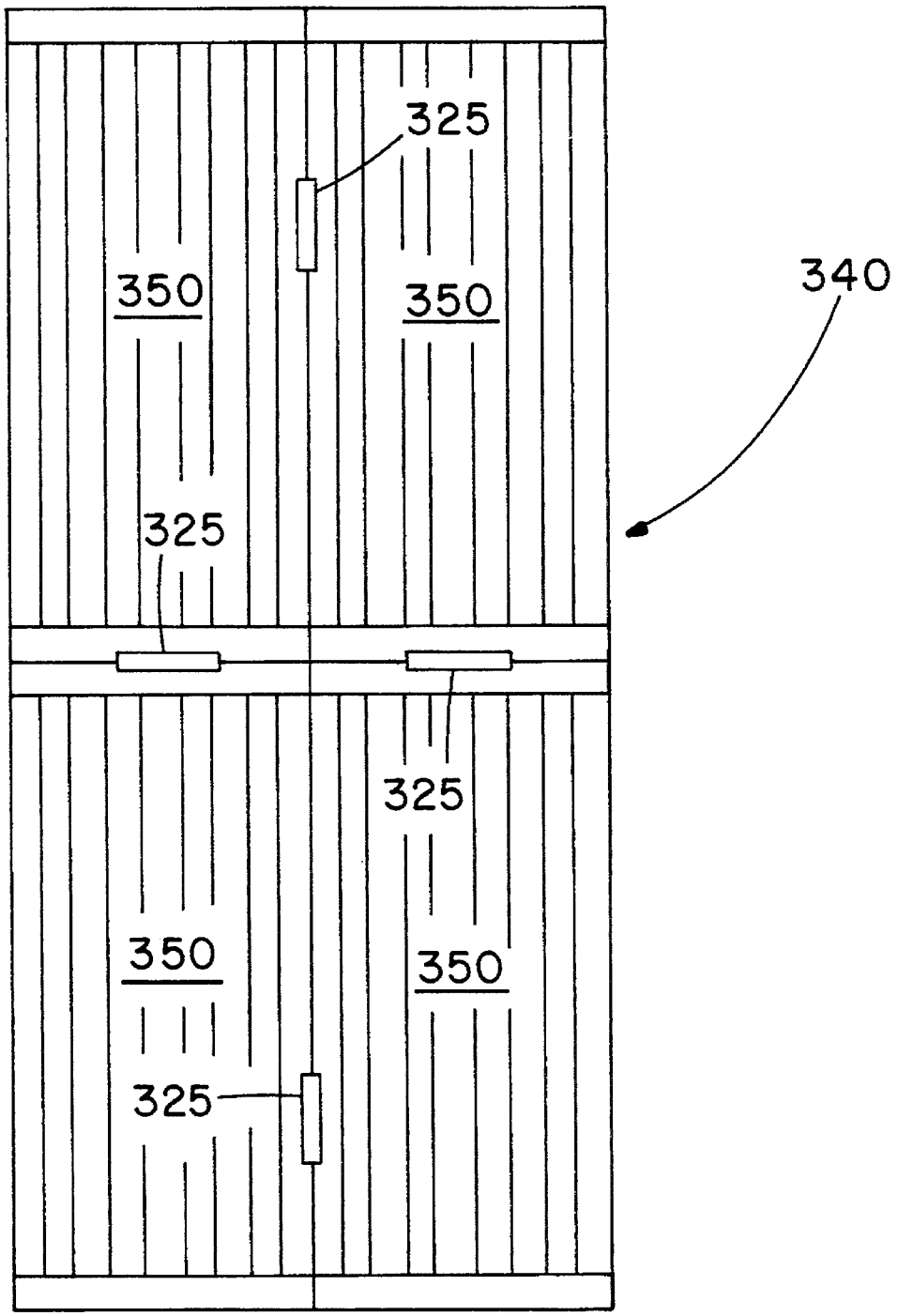
FIG. 32 is a plan view of an assembled twin size extra long modular box spring in which the spring members and covering are removed to show the connection of the frames of each adjacent module.
Figure 33:
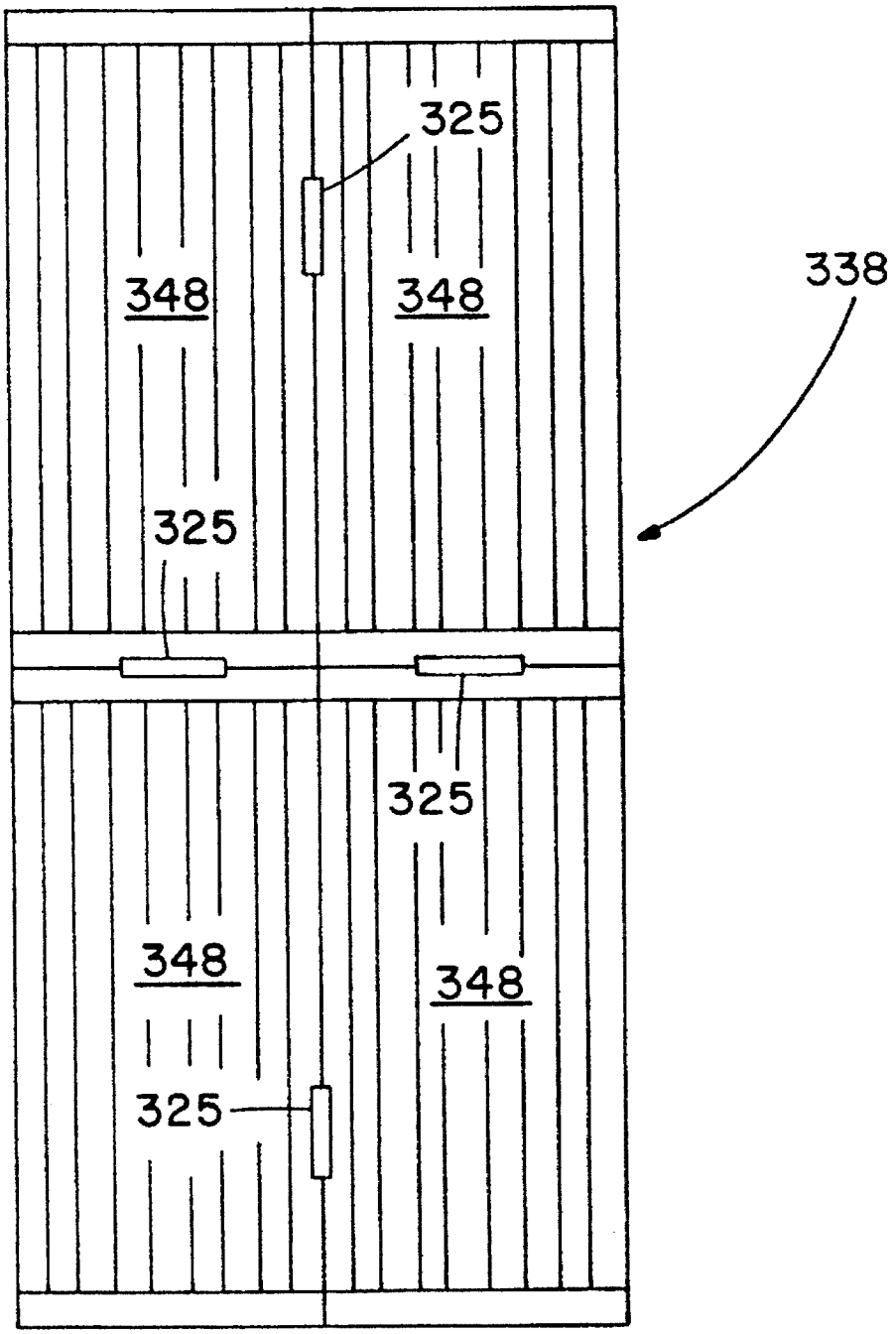
FIG. 33 is a plan view of an assembled twin size modular box spring in which the spring members and covering are removed to show the connection of the frames of each adjacent module.

A modular innerspring assembly in accordance with this invention comprises six separate modules of different sizes which can be put together in different combinations to make a king size innerspring assembly, a queen size innerspring assembly, a full innerspring assembly, a twin innerspring assembly, a twin innerspring assembly extra long and a full innerspring assembly extra long.

Each innerspring module 2 comprises a plurality of coil springs 4 in side by side relationship, each coil spring 4 secured to the other by helical wire fasteners 6 at their top coils 8 and their bottom coils 10.

First innerspring module 12 comprises a plurality of inter-connected coil springs 4 having a bearing surface dimension eighteen inches wide or laterally and twenty four inches long or longitudinally.

Second innerspring modules 22 comprises a plurality of inter-connected coil springs 4 having a bearing surface dimension eighteen inches wide or laterally and twenty six inches long or longitudinally.

Third innerspring modules 32 comprises a plurality of inter-connected coil springs 4 having a bearing surface dimension twenty-six inches wide or laterally and twenty four inches long or longitudinally.

Fourth innerspring module 42 comprises a plurality of inter-connected coil springs 4 having a bearing surface dimension twenty-six inches wide or laterally and twenty six inches long or longitudinally.

Fifth innerspring module 52 comprises a plurality of inter-connected coil springs 4 having a bearing surface dimension twenty nine inches wide or laterally and twenty six inches long or longitudinally.

Sixth innerspring module 62 comprises a plurality of inter-connected coil springs 4 having a bearing surface dimension sixteen inches wide or laterally and twenty six inches long or longitudinally.

Each of the innerspring modules 2 have a peripheral side wall 14, which includes a first side wall 16, a second side wall 18 extending at a right angle from one end of side wall 16, a third side wall 20 extending at a right angle from one end of side wall 18, and a fourth side wall 24 extending at a right angle from side wall 20 to join the other end of side wall 16.

To make a king size innerspring assembly 26 having a bearing surface dimension of seventy four inches wide or laterally and seventy eight inches long or longitudinally, six of the fifth innerspring modules 52 and three of the sixth innerspring modules 62 are assembled together as follows.

Starting with a first innerspring module 52 at the upper left corner, a first innerspring module 62 is placed with its fourth side wall 24 adjacent the second side wall 18 of the first module 52. A second module 52 is placed with its fourth side wall 24 adjacent the second side wall 18 of the first module 62. A third module 52 is placed with its first side wall 16 adjacent the third side wall 20 of the first module 52. A second module 62 is placed with its first side wall 16 adjacent the third side wall 20 of the first module 62 and with its fourth side wall 24 adjacent the second side wall 18 of the third module 52. A fourth module 52 is placed with its first side wall 16 adjacent the third side wall 20 of the second module 52 and with its fourth side wall 24 adjacent the second side wall 18 of the second module 62. A fifth module 52 is placed with its first side wall 16 adjacent the third side wall 20 of the third module 52. A third module 62 is placed with its first side wall 16 adjacent the third side wall 20 of the second module 62 and with its fourth side wall 24 adjacent the second side wall 18 of the fifth module 52. A sixth module 52 is placed with its first side wall 16 adjacent the third side wall 20 of the fourth module 52 and with its fourth side wall 24 adjacent the second side wall 18 of the third module 62.

A first peripheral border wire assembly 28 is then secured to the top coils 8 of the coil springs 4 which are located along the outer periphery of the assembled king size innerspring assembly 26 by connecting clips 30. A second peripheral border wire assembly 34 is next secured to the bottom coils 10 of those coil springs 4 which are located along the outer periphery of the assembled kind size innerspring assembly 26 by connecting clips 30.

To make a queen size innerspring assembly 36 having a bearing surface dimension of fifty eight inches wide or laterally and seventy eight inches long or longitudinally, six of the fifth innerspring modules 52 are connected together as follows.

Starting with a first module 52 at the upper left corner, a second module 52 is placed with its fourth side wall 24 adjacent to the second side wall 18 of the first module 52. A third module 52 is placed with its first side wall 16 adjacent the third side wall 20 of the first module 52. A fourth module 52 is placed with its first side wall 16 adjacent the third side wall 20 of the second module 52 and with its fourth side wall 24 adjacent the second side wall 18 of the third module 52. A fifth module 52 is placed with its first side wall 16 adjacent the third side wall 20 of the third module 52. A sixth module 52 is placed with its first side wall 16 adjacent the third side wall 20 of the fourth module 52 and with its fourth side wall 24 adjacent the second side wall 18 of the fifth module 52.

A third peripheral border wire assembly 38 is then secured to the top coils 8 of the coil springs 4 which are located around the outer periphery of the assembled queen size innerspring assembly 36 by connecting clips 30. A fourth peripheral border wire assembly 44 is next secured to the bottom coils 10 of those coil springs 4 which are located along the outer periphery of the assembled queen size innerspring assembly 36 by connecting clips 30.

To make a full extra long size innerspring assembly 46 having a bearing surface dimension of fifty two inches wide or laterally and seventy eight inches long or longitudinally, six of the fourth innerspring modules 42 are connected together as follows.

Starting with a first module 42 at the upper left corner, a second module 42 is placed with its fourth side wall 24 adjacent to the second side wall 18 of the first module 42. A third module 42 is placed with its first side wall 16 adjacent to the third side wall 20 of the first module 42. A fourth module 42 is placed with its first side wall 16 adjacent to the third side wall 20 of the second module 42 and with its fourth side wall 24 adjacent to the second side wall 18 of the third module 42. A fifth module 42 is placed with its first side wall 16 adjacent to the third side wall 20 of the a third module 42. A sixth module 42 is placed with its first side wall 16 adjacent to the third side wall 20 of the fourth module 42 and with its fourth side wall 24 adjacent to the second side wall 18 of the fifth module 42.

A fifth peripheral border wire assembly 48 is then secured to the top coils 8 of the coil spring 4 which are located around the outer periphery of the assembled full size extra long innerspring assembly 46 by connecting clips 30. A sixth peripheral border wire assembly 54 is next secured to the bottom coils 10 of those coil springs 4 which are located along the outer periphery of the assembled full size extra long innerspring assembly 46 by connecting clips 30.

To make a full size innerspring assembly 56 having a bearing surface dimension of fifty two inches wide or laterally and seventy two inches long or longitudinally, six of the third innerspring modules 32 are connected together as follows.

Starting with the first module 32 at the upper left corner, a second module 32 is placed with its fourth side wall 24 adjacent to the second side wall 18 of the first module 32. A third module 32 is placed with its first side wall 16 adjacent to the third side wall 20 of the first module 32. A fourth module 32 is placed with its first side wall 16 adjacent to the third side wall 20 of the second module 32 and with its fourth side wall 24 adjacent to the second side wall 18 of the third module 32. A fifth module 32 is placed with its first side wall 16 adjacent to the third side wall 20 of the third module 32. A sixth module 32 is placed with its first side wall 16 adjacent to the third side wall 20 of the fourth module 32 and with its fourth side wall 24 adjacent to the second side wall 18 of the fifth module 32.

A seventh peripheral border wire assembly 58 is then secured to the top coils 8 of the coil springs 4 which are located around the outer periphery of the assembled full size innerspring assembly 56 by connecting clips 30. An eighth peripheral border wire assembly 64 is next secured to the bottom coils 10 of those coil springs 4 which are located along the outer periphery of the assembled full size innerspring assembly 56 by connecting clips 30.

To make a twin size extra long innerspring assembly 66 having a bearing surface dimension of thirty six inches wide or laterally and seventy eight inches long or longitudinally, six of the second innerspring modules 22 are connected together as follows.

Starting with the first module 22 at the upper left corner, a second module 22 is placed with its fourth side wall 24 adjacent to the second side wall 18 of the first module 22. A third module 22 is placed with its first side wall adjacent to the third side wall 20 of the first module 22. A fourth module 22 is placed with its first side wall 16 adjacent to the third side wall 20 of the second module 22 and with its fourth side wall 24 adjacent to the second side wall 18 of the third module 22. A fifth module 22 is placed with its first side wall 16 adjacent to the third side wall 20 of the third module 22. A sixth module 22 is placed with its first side wall 16 adjacent to the third side wall 20 of the fourth module 22 and with its fourth side wall 24 adjacent to the second side wall 18 of the fifth module 22.

A ninth peripheral border wire assembly 68 is then secured to the top coils 8 of the coil springs 4 which are located around the outer periphery of the assembled twin size extra long innerspring assembly 66 by connecting clips 30. A tenth peripheral border wire assembly 74 is next secured to the bottom coils 10 of those coil springs 4 which are located along the outer periphery of the assembled twin size extra long innerspring assembly 66 by connecting clips 30.

To make a twin size innerspring assembly 76 having a bearing surface dimension of thirty six inches wide or laterally and seventy two inches long or longitudinally, six of the first innerspring modules 12 are connected together as follows.

Starting with the first module 12 at the upper left corner, a second module 12 is placed with its fourth side wall 24 adjacent to the second side wall 18 of the first module 12. A third module 12 is placed with its first side wall 16 adjacent to the third side wall 20 of the first module 12. A fourth module 12 is placed with its first side wall 16 adjacent to the third side wall 20 of the second module 12 and with its fourth side wall 24 adjacent to the second side wall 18 of the third module 12. A fifth module 12 is placed with its first side wall 16 adjacent to the third side wall 20 of the third module 12. A sixth module 12 is placed with its first side wall 16 adjacent to the third side wall 20 of the fourth module 12 and with its fourth side wall 24 adjacent to the second side wall 18 of the fifth module 12.

An eleventh peripheral border wire assembly 78 is then secured to the top coils 8 of the coil springs 4 which are located around the outer periphery of the assembled twin size innerspring assembly 76 by connecting clips 30. A twelfth peripheral border wire assembly 84 is next secured to the bottom coils 10 of those coil springs 4 which are located along the outer periphery of the assembled twin size innerspring assembly 76 by connecting clips 30.

The border wire assemblies 28 and 34 each comprise the following components. A first L-shaped corner wire 90 having a short leg 92 is positioned with the short leg 92 adjacent the first side wall 16 of the first innerspring module 52 with an integrally joined long leg 94 extending normal to the short leg 92 and lying adjacent the fourth side wall 24 of the first module 52, the linear dimension of the short leg 92 corresponding to that of the first side wall 16 of the first module 52, the linear dimension of the long leg 94 corresponding to that of the fourth side wall 24 of first module 52. A sleeve member 96 snugly receives the free end of short leg 92 about half way into its bore and a similar sleeve member 98 snugly receives the free end of long leg 94 about half way into its bore.

A first straight wire 100 is positioned adjacent the first side wall 16 of the second module 52 and has a linear dimension corresponding to that of the first side wall 16 of the second module 52. One end of the straight wire 100 is snugly received about half way into the bore of sleeve member 96 to abut against the free end of short leg 90 received therein from the opposite end. A sleeve member 108 snugly receives the opposite end of the straight wire 100 about half way into its bore.

A second L-shaped corner wire 110 having a short leg 112 is positioned with short leg 112 adjacent the first side wall 16 of the third module 52 and having an integrally joined long leg 114 extending normal to the short leg 112 lying adjacent the second side wall 18 of the third module 52, the linear dimension of the short leg 112 corresponding to that of the first side wall 16 of the third module 52, the linear dimension of the long leg 114 corresponding to that of the second side wall 18 of the third module 52. The free end of the short leg 112 is snugly received in the bore of sleeve member 108 about halfway to abut against the facing end of the straight wire 100 received therein from the opposite end of sleeve member 108. A sleeve member 118 snugly receives the free end of the long leg 114 about half way into its bore.

A second straight wire 120 is positioned adjacent the fourth side wall 24 of the fourth module 52 and has a linear dimension corresponding to that of the fourth side wall 24 of the fourth module 52. One end of the straight wire 120 is snugly received about half way into the bore of sleeve member 98 to abut against the free end of long leg 94 of the first L-shaped corner wire which is received therein from the opposite end. A sleeve member 128 snugly receives the opposite free end of the second straight wire 120 about half way into its bore.

A third straight wire 130 is positioned adjacent the second side wall 18 of the sixth module 52 and has a linear dimension corresponding to that of the second side wall 18 of the sixth module 52. One end of the straight wire 130 is snugly received about half way into the bore of sleeve member 118 to abut against the free end of long leg 114 of the second L-shaped corner wire 110 which is received therein from the opposite end. A sleeve member 138 snugly receives the opposite free end of the third straight wire 130 about half way into its bore.

A third corner wire 140 having a short leg 142 lies with its short leg 142 adjacent the third side wall 20 of the seventh module 52, also having an integrally joined long leg 144 extending normal to the short leg 142 lying adjacent the fourth side wall 24 of the seventh module 52, the linear dimension of the short leg 142 corresponding to that of the third side wall 20 of the seventh module 52, the linear dimension of the long leg 144 corresponding to that of the fourth side wall 24 of the seventh module 52. A sleeve member 148 snugly receives the free end of short leg 142 about half way into its bore. The free end of long leg 144 is snugly received about half way into the bore of sleeve member 128 to abut against the free end of the second straight wire 120 which is received in the bore of sleeve member 128 from the opposite end.

A fourth straight wire 150 is positioned adjacent the third side wall 20 of the eighth module 52 and has a linear dimension corresponding to that of the third side wall 20 of the eighth module 52. One end of the straight wire 150 is snugly received about half way into the bore of sleeve member 148 to abut against the free end of short leg 142 of the third corner wire 140 which is received therein from the opposite end. A sleeve member 158 snugly receives the opposite free end of the fourth straight wire 150 about half way into its bore.

A fourth corner wire 160 having a short leg 162 is positioned with its short leg 162 adjacent the third side wall 20 of the ninth module 52, also having an integrally joined long leg 164 extending normal to the short leg 162 and lying adjacent the second side wall 18 of the ninth module 52, the linear dimension of the short leg 162 corresponding to that of the third side wall 20 of the ninth module 52, the linear dimension of the long leg 164 corresponding to that of the second side wall 18 of the ninth module 52. The free end of the short leg 162 of the fourth corner wire 160 is received about half way into the bore of sleeve member 158 to abut against the free end of the fourth straight wire 150 received therein from the opposite end. The free end of the long leg 164 of the fourth corner wire 160 is received about half way into the bore of sleeve member 138 to abut against the free end of the third straight wire 130 received therein from the opposite end.

Each of the sleeve members 96, 98, 108, 118, 128, 138, 148 and 158 are elongated, preferably between three and a half to four inches in length to receive the free ends of the respective corner wires 90, 110, 140 and 160 and of the respective straight wires 100, 120, and 130 and 150 about one and three quarters inches to two inches within the bores of the sleeve members. The free ends of the wire cannot slip out of the respective sleeve members when the module innerspring assembly in accordance with this invention has been assembled. The connecting clips 30 secure each of the wires making up the border wire assemblies 28 and 34 for king size innerspring assembly 26, border wire assemblies 38 and 44 for queen size innerspring assembly 36, border wire assemblies 48 and 54 for full size extra long innerspring assembly 46, border wire assemblies 58 and 64 for full size innerspring assembly 56, border wire assemblies 68 and 74 for twin size extra long innerspring assembly 66, and border wire assemblies 78 and 84 for twin size innerspring assembly 76 to the coil springs 4 which lie adjacent thereto.

The clips 30 each comprise a short relatively broad and slightly resilient metal strip 200 terminating at one end in a first arcuate hook 202 having a loop 204 having a radius whose configuration and dimension corresponds to that of the top coil 8 and bottom coil 10 of each respective coil spring 4 and having an entrance 206 opening to said loop of said arcuate hook having a dimension which is slightly less than the cross-sectional dimension of top coil 8 and bottom coil 10. The free end 208 of the first arcuate hook 202 is resilient enough to spread apart slightly to permit the coil 8 and coil 10 of coil spring 4 to pass through the entrance 206 and into the loop 204 of the arcuate hook 202, the free end 208 snaps back and the respective coil 8 or coil 10 is snugly received and securely held within the loop 204.

The clips 30 each terminate at the opposite end in a second arcuate hook 212 having a loop 214 having a radius whose configuration and dimension corresponds to that of the corner wires 90, 110, 140 and 160 and straight wires 100, 120, 130 and 150, and having an entrance 216 opening to said loop 214 having a dimension which is slightly less than the cross-sectional dimension of such wires. The free end 218 of the second arcuate hook 212 is resilient enough to spread apart slightly to permit a respective one of such wires to pass through the entrance 216 and into the loop 214 of the arcuate hook 212, the free end 218 snaps back and the respective one such wires is snugly received and securely held within the loop 214 of the second arcuate hook 212 of the clip 30.

The component parts of the border wire assemblies 28 and 34 around the upper and lower peripheral edges of the king size innerspring assembly 26 have been described in detail above. The components for the border wire assemblies of the queen, full extra long, full, twin extra long and twin are similar, except that a first straight wire corresponding to straight wire 100 and a fourth straight wire corresponding to straight wire 150 needed for the king at each opposite end where they extend laterally are not needed for the queen, full extra long, full, twin extra long and twin. The king is made up of nine innerspring modules 2, comprising three lateral rows of three in each row. Each of the others is made up of six innerspring modules 2, comprising three lateral rows of only two in each row. Also, the dimension of the corner wires and straight wires for each of the various sizes of the border wire assemblies for the completed modular innerspring assemblies in accordance with this invention vary to correspond in linear dimension to that of the particular innerspring module 2 to which each corner wire and straight wire will be placed adjacent and connected by the connecting clips 30.

It is not necessary therefor to describe each of the component parts of the other border wire assemblies 38 and 44 (queen size), 48 and 54 (full size extra long), 58 and 64 (full size), 68 and 74 (twin size extra long) and 78 and 84 (twin size) in the detail needed to describe one of the sets of border wire assemblies, namely border wire assemblies 28 and 34 for the king size innerspring assembly 26 which is the one selected for detail description as set forth above.

A modular box spring assembly is also provided as the foundation for the modular innerspring assemblies in accordance with this invention. The modular box spring assembly comprises five separate box spring modules 302 of different sizes which can be put together in different combinations to make a twin size box spring, a twin size extra long box spring, a full size box spring, a full size extra long box spring, and a queen size box spring. For a king size mattress, two twin size extra long box springs are utilized.

Each box spring module 302 comprises a plurality of Z-shaped wire springs 304 in side by side relationship, each having a first or upper laterally extending leg 306 terminating in a free end 308 and a second or lower laterally extending leg 310 terminating in a free end 312, each laterally extending leg 306 and 310 being integrally formed as part of the Z-shaped wire spring 304.

Each box spring module 302 also comprises a base frame 314, preferably of wood, including a first laterally extending end strip 316 across one end, a second laterally extending end strip 318 across the opposite end, a first longitudinally extending side strip 320 connected at one end to one end of first lateral end strip 316 and at its other end to one end of second lateral end strip 318, and a second longitudinally extending side strip 322 connected at one end to the other end of first lateral end strip 316 and at its other end to the other end of second lateral end strip 318. A plurality of longitudinally extending support slats 324 are spaced apart between side strips 320 and 322, each secured at one end to the first lateral end strip 316 and at the other end to the second lateral end strip 318.

An elongated L-shaped angle iron 326, comprising a first or horizontal leg 326 and an integrally joined second or vertical leg 328, has its first or horizontal leg 326 bolted to the underside of the second longitudinally extending side strip 322 of each box spring module 302, and to the underside of the second laterally extending end strip 318 of each box spring module 302. When so bolted, the second or vertical leg 328 of the angle iron 326 has a projecting portion 330 which extends slightly above the plane of the upper surface of the longitudinally extending side strip 322 and the laterally extending end strip 318 to which they are respectively secured. A pair of apertures 332 extend through the upwardly projecting portion 330.

The angle irons 326 are positioned on each longitudinally extending side strip 322 and on each laterally extending and strip 318 so they come into full facing relationship with the respective side and end angle irons of other box spring modules 302 of corresponding dimensions when they are placed in full facing relationship with their respective second longitudinally extending side strips 322 adjacent each other, or with their respective second laterally extending end strips 318 adjacent each other. When so placed, the apertures 332 of the angle irons 326 which are then in full facing relationship will be in registration to receive connecting bolts 334 therethrough to secure the adjacent box spring modules 302 together.

A top layer 336 of mesh material is placed over the top of each box spring module 30.

The first or upper laterally extending leg 306 of each Z-shaped wire spring 304 is secured to the top layer 336 by a clip and the second or lower laterally extending leg 310 of each Z-shaped wire spring 304 is secured to respective ones of the longitudinally extending side strips 320 and 322 or to respective ones of the longitudinally extending support slats 324, which respective ones of the Z-shaped wire springs 304 are facing and bearing against.

The five box spring modules 302 of different sizes needed to put together a twin size modular box spring 338, a twin size extra long modular box spring 340, a full size modular box spring 342, a full size extra long modular box spring 344 and a queen size modular box spring 346 in accordance with this invention are described as follows. For a king size mattress, two twin size extra long modular box springs 340 are placed side by side to support a king size innerspring mattress.

A twin size box spring module 348 has a width or lateral dimension of eighteen inches and a length or longitudinal dimension of thirty seven inches. Two of such box spring modules 348 are placed in side by side relationship with their respective second longitudinal side strips 322 adjacent each other, then secured together by bolts through the apertures 332 of the respective angle irons 326. A third box spring module 348 is placed with its second laterally extending end strip 318 adjacent the second laterally extending end strip 318 of one of the first two box spring modules 348 with the second longitudinally extending side strip 322 of the third box spring module 348 in line with the same side strip 322 of the box spring module 348 against which it is placed adjacent. A fourth box spring module 348 is then placed with its second laterally extending end strip 319 adjacent the second laterally extending end strip 318 of the other of the first two box spring modules 348 with its second longitudinally extending side strip 322 then being adjacent the second longitudinally extending side strip 322 of the third box spring module 348. The third and fourth box spring modules 348 are then secured to respective ones of the first two box spring modules 348 and to each other by bolts through the apertures 332 of the respective angle irons 326 which are at such time in full facing relationship one with another. This completes the assembly of a twin size modular box spring 338.

A twin size extra long box spring module 350 has width or lateral dimension of eighteen inches and a length or longitudinal dimension of thirty nine inches. Two of such box spring modules 350 are placed in side by side relationship with their respective second longitudinal side strips 322 adjacent each other, then secured together by bolts through the aperture 332 of the respective angle irons 326. A third box spring module 350 is placed with its second laterally extending end strip 318 adjacent the second laterally extending end strip 318 of one of the first two box spring modules 350 with the second longitudinally extending side strip 322 of the third box spring module 350 in line with the same side strip 322 of the box spring module 350 against which it is placed adjacent. A fourth box spring module 350 is then placed with its second laterally extending end strip 318 adjacent the second laterally extending end strip 318 of the other of the first two box spring modules 350 with its second longitudinally extending side strip 322 then being adjacent the second longitudinally extending side strip 322 of the third box spring module 350. The third and fourth box spring modules 350 are then secured to respective ones of the first two box spring modules 350 and to each other by bolts through the apertures 332 of the respective angle irons 326 which are at such time in full facing relationship one with another. This completes the assembly of a twin size extra long modular box spring 340.

A full size box spring module 352 has a width or lateral dimension of twenty six inches and a length or longitudinal dimension of thirty seven inches. Two of such box spring modules 352 are placed in side by side relationship with their respective second longitudinal side strips 322 adjacent each other, then secured together bolts through the aperture 332 of the respective angle irons 326. A third box spring module 352 is placed with its second laterally extending end strip 318 adjacent the second laterally extending end strip 318 of one of the first two box spring modules 352 with the second longitudinally extending side strip 322 of the third box spring module 352 in line with the same side strip 322 of the box spring module 352 against which it is placed adjacent. A fourth box spring module 352 is then placed with its second laterally extending end strip 318 adjacent the second laterally extending end strip 318 of the other of the first two box spring modules 352 with its second longitudinally extending side strip 322 then being adjacent the second longitudinally extending side strip 322 of the third box spring module 352. The third and fourth box spring modules 352 are then secured to respective ones of the first two box spring modules 352 and to each other by bolts through the apertures 332 of the respective angle irons 326 which are at such time in full facing relationship one with another. This completes the assembly of a full size modular box spring 342.

A full size extra long box spring module 354 has width or lateral dimension twenty six inches and a length or longitudinal dimension of thirty nine inches. Two of such box spring modules 354 are placed in side by side relationship with their respective second longitudinal side strips 322 adjacent each other, then secured together by bolts through the aperture 332 of the respective angle irons 326. A third box spring module 354 is placed with its second laterally extending end strip 318 adjacent the second laterally extending end strip 318 of one of the first two box spring modules 354 with the second longitudinally extending side strip 322 of the third box spring module 354 in line with the same side strip 322 of the box spring module 354 against which it is placed adjacent. A fourth box spring module 354 is then placed with its second laterally extending end strip 318 adjacent the second laterally extending end strip 318 of the other of the first two box spring modules 354 with its second longitudinally extending side strip 322 then being adjacent the second longitudinally extending side strip 322 of the third box spring module 354. The third and fourth box spring modules 354 are then secured to respective ones of the first two box spring modules 354 and to each other by bolts through the apertures 332 of the respective angle irons 326 which are at such time in full facing relationship one with another. This completes the assembly of a full size extra long modular box spring 344.

A queen size box spring module 356 has a width or lateral dimension of twenty nine inches and a length or longitudinal dimension of thirty nine inches. Two of such box spring modules 356 are placed in side by side relationship with their respective second longitudinal side strips 322 adjacent each other, then secured together by bolts through the aperture 332 of the respective angle irons 326. A third box spring module 356 is placed with its second laterally extending end strip 318 adjacent the second laterally extending end strip 318 of one of the first two box spring modules 356 with the second longitudinally extending side strip 322 of the third box spring module 356 in line with the same side strip 322 of the box spring module 356 against which it is placed adjacent. A fourth box spring module 356 is then placed with its second laterally extending end strip 318 adjacent the second laterally extending end strip 318 of the other of the first two box spring modules 356 with its second longitudinally extending side strip 322 then being adjacent the second longitudinally extending side strip 322 of the third box spring module 356. The third and fourth box spring modules 356 are then secured to respective ones of the first two box spring modules 356 and to each other by bolts through the apertures 332 of the respective angle irons 326 which are at such time in full facing relationship one with another. This completes the assembly of a queen size modular box spring 346.

Figure 34:
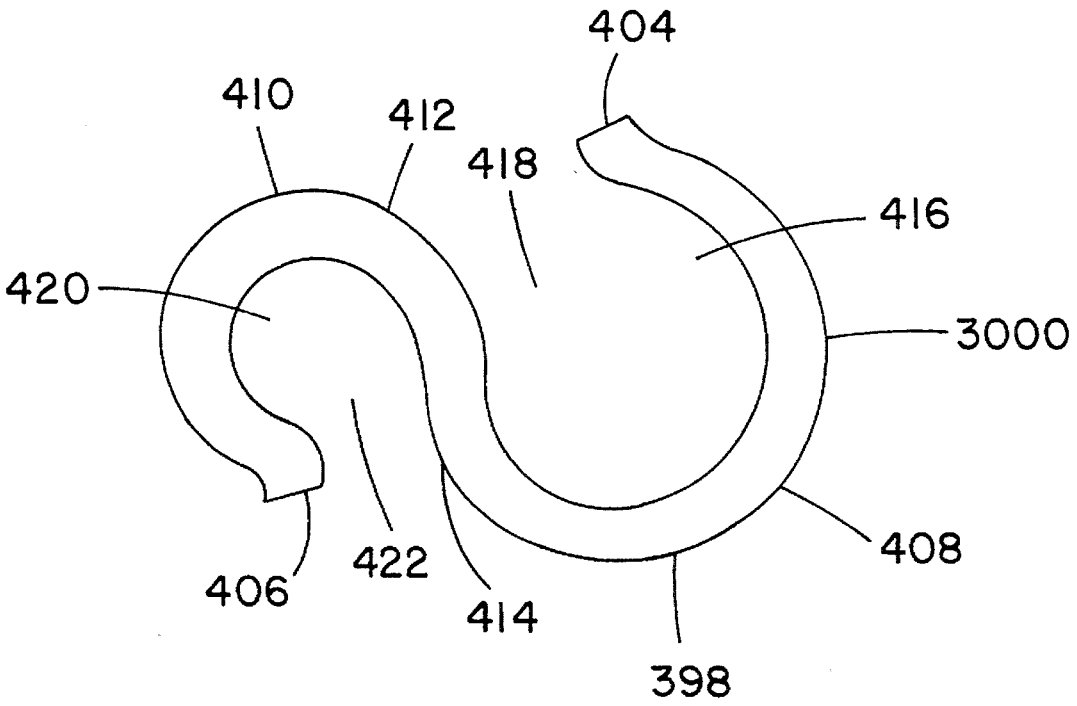
FIG. 34 is a side elevation view of a modified connecting clip which secures the peripheral border wire assemblies to the coils of adjacent coil springs.
Figure 35:
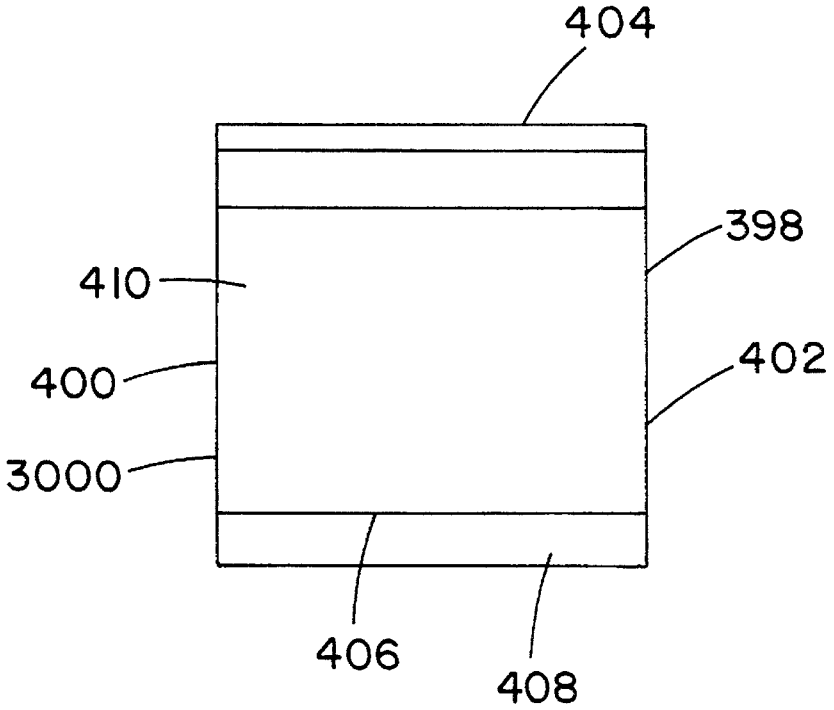
FIG. 35 is an end elevation view of the modified connecting clip shown in FIG. 34.

A modified clip 3000 as shown in FIGS. 34 and 35 is provided to connect the border wire assemblies 28 and 34 to the top coils 8 and bottom coils 10, respectively, of the coil springs 4 of an innerspring assembly.

The modified clip 3000 comprises a relatively wide unitary strip of metal 398 having a spring characteristic which may be about three-eighths of an inch wide between side edges 400 and 402, having an elongated linear dimension which may be about three-eighths to one-half inch from one end 404 to the opposite end 406 in its original flat configuration. The metal strip 398 is curved to form two reverse loops 408 and 410.

The first loop 408 extends from end 404 in an arcuate path which curves generally in a clockwise direction when end 404 is to the right as in FIG. 34 to a first loop entrance point 412 opposite from and spaced apart from the end 404. The metal strip 398 is then curved from that point 412 in a generally counterclockwise direction as seen in FIG. 34 to terminate at the opposite end 406 which is to the left, opposite from second loop entrance point 414 and spaced apart therefrom, thereby forming the second loop 410.

The first loop 408 has a substantially cylindrical loop pocket 416 which corresponds in cross-sectional configuration and dimension to that of the corner wires 90, 110, 140 and 160, and straight wires 100, 120, 130 and 150 which make up the border wire assemblies, whereby they are received in loop pocket 416 in a tight, snug fit. The first loop 408 has a loop entrance 418 opening to loop pocket 416 bounded on one side by end 404 and on the other side by first loop entrance point 412 which is spaced apart a distance less than the diameter or cross-sectional dimension of the said wires of the border wire assemblies 28 and 34. The end 404 of the metal strip 398 can be spread apart against the spring bias characteristic of metal strip 398 enough to allow a wire of the border wire assemblies to pass through into loop pocket 416 whereupon it snaps back to its original position to hold the wire securely in loop pocket 416 until such time as it may be desired to remove.

The second loop 410 also has a substantially cylindrical loop pocket 420 which is smaller than loop pocket 416, and which corresponds in cross-sectional configuration and dimension to that of the top coil 8 and bottom coil 10 of the coil springs 4, whereby such coils are received in loop pocket 420 in a tight snug fit. The second loop 410 has a loop entrance 422 opening to loop pocket 420 bounded on one side by end 406 and on the other side by second loop entrance point 414 which is spaced apart a distance less than the diameter or cross-sectional dimension of the said coils of the coil springs 4. The end 406 can be spread apart against the spring bias characteristic of metal strip 398 enough to allow a coil of the spring to pass through into loop pocket 420 whereupon it snaps back to its original position to hold the coil of the coil spring securely in loop pocket 420 until such time as it may be desired to remove.

The modified clip 3000 may also be made of materials other than metal which have relative structural stability and a spring bias characteristic.

When the unitary strip 398 is formed as described, the entrance into loop pocket 416 from its loop entrance 418 is in one direction, such as downwardly as shown in FIG. 34, while the entrance into loop pocket 420 from its loop entrance 422 is in the opposite direction, such as upwardly as shown in FIG. 34.

I claim:

1. A mattress spring clip comprising a unitary strip of material having a spring bias characteristic, said unitary strip having a first side edge, a second side edge spaced apart from said first side edge to define a relatively wide wall therebetween, a first end an an opposite second end, said unitary strip curving arcuately in a clock-wise direction from said first end to a first loop entrance point of said unitary strip substantially opposite from and spaced apart a pre-determined distance from said first end to define a first loop entrance therebetween having a first loop entrance space, a first loop pocket formed by said unitary strip curving arcuately in a clock-wise direction from said first end to said first loop entrance point of said unitary strip, said unitary strip curving arcuately in a counterclock-wise direction from its said first loop entrance point to said second end, a second loop entrance point of said unitary strip substantially opposite from and spaced apart a pre-determined distance from said second end to define a second loop entrance therebetween having a second loop entrance space and a second loop pocket formed by said unitary strip curving arcuately in a counterclock-wise direction from its said first loop entrance point to said second end, said first end of said unitary strip of material having said spring bias characteristic being movable against said spring bias away from its said spaced apart pre-determined distance from said first loop entrance point when flexing pressure is applied thereto and returnable to said predetermined spaced apart distance when said flexing pressure is released, said second end of said unitary strip of material having said spring bias characteristic being movable against said spring bias away from its said spaced apart pre-determined distance from said second loop entrance point when flexing pressure is applied thereto and returnable to said pre-determined spaced apart distance when said flexing pressure is released.

2. A mattress spring clip as set forth in claim 1, wherein said first loop entrance opens to said first loop pocket in one direction and said second loop entrance opens to said second loop pocket in substantially the direction opposite from said one direction.

3. A mattress spring clip as set forth in claim 1, wherein said first loop pocket has a larger cross-sectional dimension than said second loop pocket.

4. A mattress spring clip as set forth in claim 1, wherein the configuration of said first loop pocket is substantially cylindrical.

5. A mattress spring clip as set forth in claim 4, wherein the configuration of said second loop pocket is substantially cylindrical.

6. A mattress spring clip as set forth in claim 1, wherein said first loop entrance space is narrower than the cross-sectional dimension of said first loop pocket.

7. A mattress spring clip as set forth in claim 6, wherein said second loop entrance space is narrower than the cross-sectional dimension of said second loop pocket.

8. A mattress spring clip, wire of a border wire assembly, and coil of a coil spring in combination, wherein said spring clip comprises a unitary strip of material having a spring bias characteristic, said unitary strip having a first side edge, a second side edge spaced apart from said first side edge to define a relatively wide wall therebetween, a first end and an opposite second end, said unitary strip curving arcuately in a clock-wise direction from said first end to a first loop entrance point of said unitary strip substantially opposite from and spaced apart a pre-determined distance from said first end to define a first loop entrance therebetween having a first loop entrance space, a first loop pocket formed by said unitary strip curving arcuately in a clock-wise direction from said first end to said first loop entrance point of said unitary strip, said unitary strip curving arcuately in a counterclock-wise direction from its said first loop entrance point to said second end, a second loop entrance point of said unitary strip substantially opposite from and spaced apart a pre-determined distance from said second end to define a second loop entrance therebetween having a second loop entrance space and second loop pocket formed by said unitary strip curving arcuately in a counterclock-wise direction from its said first loop entrance point to said second end, said first end of said unitary strip of material having said spring bias characteristic being movable against said spring bias away from its said spaced apart pre-determined distance from said first loop entrance point when flexing pressure is applied thereto and returnable to said pre-determined spaced apart distance when said flexing pressure is released, said second end of said unitary strip of material having said spring bias characteristic being movable against said spring bias away from its said spaced apart pre-determined distance from said second loop entrance point when flexing pressure is applied thereto and returnable to said pre-determined spaced apart distance when said flexing pressure is released, said wire of said border wire assembly has a first cross-sectional configuration and dimension, said coil of a coil spring has a second cross-sectional configuration and dimension, said first loop pocket has a cross-sectional configuration and dimension corresponding to said first cross-sectional configuration and dimension for a tight fit of said wire of said border wire assembly therein, said second loop pocket has a cross-sectional configuration and dimension corresponding to said second cross-sectional configuration and dimension for a tight fit of said coil of a said coil spring therein.

9. A mattress spring clip, wire of a border wire assembly, and coil of a coil spring in combination as set forth in claim 8, wherein said first cross-sectional dimension is greater than said second cross-sectional dimension.

10. A mattress spring clip, wire of a border wire assembly, and coil of a coil spring in combination as set forth in claim 9, wherein said first loop entrance space is narrower than said first cross-sectional dimension and said second loop entrance space is narrower than said second cross-sectional dimension.

11. A mattress spring clip, wire of a border wire assembly, and coil of a coil spring in combination as set forth in claim 8, wherein said first cross-sectional configuration is cylindrical.

12. A mattress spring clip, wire of a border wire assembly, and coil of a coil spring in combination as set forth in claim 11, wherein said second cross-sectional configuration is cylindrical.

* * * * *